US005422612A

United States Patent [19]

Kobayashi et al.

[11] Patent Number: 5,422,612

[45] Date of Patent: Jun. 6, 1995

[54] DIELECTRIC FILTER HAVING CORRESPONDING INDIVIDUAL EXTERNAL AND GROUND ELECTRODES FORMED ON A DIELECTRIC SUBSTRATE

[75] Inventors: Yasumi Kobayashi; Kousuke Takeuchi; Kachio Ikeda; Kenichi Shibata, all of Osaka; Kazuhiko Kuroki, Kyoto, all of Japan

[73] Assignee: Sanyo Electric Co., Ltd., Moriguchi, Japan

[21] Appl. No.: 124,487

[22] Filed: Sep. 22, 1993

Related U.S. Application Data

[62] Division of Ser. No. 853,049, Mar. 18, 1992, Pat. No. 5,293,141.

[30] Foreign Application Priority Data

Mar. 25, 1991 [JP] Japan ..... 3-060393
Apr. 2, 1991 [JP] Japan ..... 3-070074
Apr. 9, 1991 [JP] Japan ..... 3-076302

[51] Int. Cl.[6] ..... H01P 1/205
[52] U.S. Cl. ..... 333/206
[58] Field of Search ..... 333/202, 206, 207, 222, 333/223, 246

[56] References Cited

U.S. PATENT DOCUMENTS 4,823,098 4/1989 DeMuro et al. ..... 333/206
4,879,533 11/1989 de Muro et al. ..... 333/206
4,937,542 6/1990 Nakatuka ..... 333/202
5,015,973 5/1991 Kawakami et al. ..... 333/132
5,079,528 1/1992 Yorita et al. ..... 333/206
5,144,269 9/1992 Itoh ..... 333/206
5,208,565 5/1993 Sogo et al. ..... 333/206

FOREIGN PATENT DOCUMENTS 350256 10/1990 European Pat. Off. .
0192101 8/1986 Japan ..... 333/202
0237501 10/1986 Japan ..... 333/202
63-311801 12/1988 Japan .

*Primary Examiner*—Seungsook Ham
*Attorney, Agent, or Firm*—Armstrong, Westerman, Hattori, McLeland & Naughton

[57] ABSTRACT

In a dielectric filter according to the present invention, a depressed part is formed by removing a portion of an outer peripheral conductor on the open face side of each of a plurality of one-end face short-circuited type coaxial resonators or a portion of the outer peripheral conductor including a dielectric member. A dielectric substrate having a plurality of capacitance forming electrodes for forming antiresonance capacitances between the electrodes and inner peripheral conductors of the coaxial resonators formed thereon is mounted on the depressed part, and a reactance element for coupling the capacitance forming electrodes is provided on the dielectric substrate.

6 Claims, 25 Drawing Sheets

DIELECTRIC FILTER HAVING CORRESPONDING INDIVIDUAL EXTERNAL AND GROUND ELECTRODES FORMED ON A DIELECTRIC SUBSTRATE

This is a division of application Ser. No. 07/853,049, filed Mar. 18, 1992 (U.S. Pat. No. 5,293,141).

BACKGROUND OF THE INVENTION

1. Field of the Invention

The present invention relates to a dielectric filter and a antenna duplexer using the same.

2. Description of the Related Art

Conventionally, a dielectric filter using a dielectric coaxial resonator has been constructed by respectively connecting one-end face short-circuited type coaxial resonators each formed by providing a dielectric member with a through hole and coating an outer peripheral surface of the dielectric member and an inner peripheral surface of the through hole with a conductive member (for example, silver) and capacitive-coupling electrodes formed on the dielectric substrate to the respective coaxial resonators.

In recent years, communication apparatuses have been decreased in weight and bulk in the field of mobile communication. With decreasing weight and bulk, smaller-sized dielectric filters have been requested.

Meanwhile, the ratio of an inner coaxial diameter to an outer coaxial diameter must be 3.6 so as to obtain a high Qu value (unloaded Q value). In manufacturing a small-sized dielectric filter, therefore, if the outer coaxial diameter is not more than 4 mm, the inner coaxial diameter is not more than 1.2 mm. It is thus difficult to insert a member for external connection into the through holes of the above described coaxial resonators to connect the same with an external circuit as described above. The present applicant has proposed U.S. patent application Ser. No. 671,615 as a dielectric filter for solving the problem.

Furthermore, when a filter is formed by coaxial resonators comprising not less than three stages, the length of the coaxial resonator in the middle stage is made longer than those of the coaxial resonators in the first stage and the final stage. Therefore, there occurs the problem that coaxial resonators having various lengths are required.

On the other hand, in the mobile communication apparatus, a antenna duplexer for separating and combining signals having different frequencies depending on the frequency is used. Such an antenna duplexer comprises a dielectric filter for transmission and a dielectric filter for reception which differ in center frequency. In such a dielectric filter, the interval between the center frequencies of a receiving band and a transmitting band becomes shorter with higher frequencies in mobile communication, so that it is difficult to obtain required out-of-passband attenuation. Therefore, the dielectric filter used in the antenna duplexer must have an attenuation pole in its characteristics.

Examples of a method of forming a pole in an attenuation region include one for directly connecting resonators by a reactance element with at least one resonator being skipped to form such a pole in a dielectric filter disclosed in Japanese Patent Laid-Open Gazette No. 77703/1987.

In this construction, however, the number of components is increased, and the assembly becomes complicated.

In order to solve the problem, a dielectric filter as shown in FIGS. 31 and 34 in Japanese Patent Application No. 46796/1991 has been proposed. Description is made of the dielectric filter with reference to the drawings. In this dielectric filter, five coaxial resonators $\mathbf{1}_1$ to $\mathbf{1}_5$ constitute a filter. Each of the resonators $\mathbf{1}_1$ to $\mathbf{1}_5$ is provided with a depressed part 2. A dielectric substrate 3 is mounted on the depressed part 2. The resonators $\mathbf{1}_1$ to $\mathbf{1}_5$ are coupled to each other through coupling windows.

Input-output connection electrode 3*a*′ and 3*a*″ and capacitance forming electrodes 3*c*′, 3*c*″ and 3*c*‴ are formed on the upper surface of the dielectric substrate 3′, while stab electrodes for external connection 3*d*′ and 3*d*″ formed by extending the input-output connection electrodes 3*a*′ and 3*a*″ and a ground electrode 3*b* are formed on the lower surface thereof.

Input-output capacitances C1 and C′1 are respectively formed between the input-output connection electrodes 3*a*′ and 3*a*″ and the resonators $\mathbf{1}_1$ and $\mathbf{1}_5$. In addition, resonator length correcting capacitances C2, C′2 and C″2 are respectively formed between the capacitance forming electrodes 3*c*, 3*c*″ and 3*c*‴ and inner peripheral conductors $\mathbf{1}d_2$, $\mathbf{1}d_3$ and $\mathbf{1}d_4$ of the coaxial resonators $\mathbf{1}_2$, $\mathbf{1}_3$ and $\mathbf{1}_4$. Furthermore, jump coupling capacitances C3, C3′ and C3″ are respectively formed between the input-output connection electrodes 3*a*′ and 3*a*″ and the capacitance forming electrodes 3*c*′, 3*c*″ and 3*c*‴.

As shown in FIGS. 33 and 34, in the dielectric filter, a pole P is formed in an attenuation region of filter characteristics by the jump coupling capacitances C3, C′3 and C″3.

In the above described dielectric filter, however, when the grounding of the ground electrode 3*b* on the dielectric substrate 3 is incomplete, a capacitive coupling is achieved between the connection electrodes 3*d*′ and 3*d*″ through the ground electrode 3*b*, significantly degrading the filter characteristics. It is difficult to obtain complete grounding particularly in a microwave band of not less than 1 GHz, which is a serious problem.

More specifically, it is actually difficult to obtain complete grounding, so that an impedance component is contained between the ground and the ground electrode 3*b*. In this case, a part, which is not coupled to the resonators, of power from the input side is directly coupled to the output side through a capacitance. In this case, the out-of-band attenuation is significantly degraded in the frequency characteristics of the filter.

In order to prevent the degradation, the ground electrode 3*b* may be removed from the dielectric substrate 3. However, there is a possibility that noise from an external circuit or element in close proximity to the filter is coupled to inner peripheral conductors $\mathbf{1}d_1$ and $\mathbf{1}d_5$ of the resonators $\mathbf{1}_1$ to $\mathbf{1}_5$ or the connection electrodes 3*d*′ and 3*d*″ on the dielectric substrate 3, resulting in degradation of the filter characteristics.

SUMMARY OF THE INVENTION

An object of the present invention is to provide a small-sized dielectric filter in which an antiresonant capacitance for obtaining filter characteristics having an attenuation pole and a coupling between coaxial resonators can be achieved with good workability.

Another object of the present invention is to provide a dielectric filter for preventing an input-output direct coupling which is achieved through a ground electrode due to the fact that the grounding of the ground electrode is in an incomplete state.

Still another object of the present invention is to provide a small-sized dielectric filter in which undesired filter characteristics in a resonance frequency in a higher TEM (Transverse electromagnetic) mode can be solved without complicating a circuit.

A further object of the present invention is to provide an antenna duplexer using the dielectric filter as filters for transmission and reception.

A still further object of the present invention is to make a matching circuit for matching input impedances smaller in size in providing a antenna duplexer using the dielectric filter as filters for transmission and reception, to achieve smaller size and higher performance of the antenna duplexer.

In view of the above described points, a dielectric filter according to a first embodiment of the present invention comprises a plurality of coaxial resonators, each of the above described coaxial resonators comprising a dielectric block having an outer peripheral surface and an inner peripheral surface parallel to a common axis and having first and second end faces crossing the common axis, first and second conductive layers coating the outer peripheral surface and the inner peripheral surface, a third conductive layer formed on the second end face for short-circuiting the first and second conductive layers, and a depressed part formed by removing a portion of the first conductive layer on the side of the first end face or a portion of the first conductive layer including the dielectric block; a dielectric substrate having a plurality of capacitance forming electrodes for forming capacitances between the electrodes and the second conductive layers of the coaxial resonators and external connection means formed thereon and mounted on the depressed part; and reactance means provided on the dielectric substrate for coupling the capacitance forming electrodes to each other.

Furthermore, a dielectric filter according to a second embodiment of the present invention comprises a dielectric block having an outer peripheral surface and a plurality of inner peripheral surfaces parallel to a common axis and having first and second end faces crossing the common axis; a first conductor layer formed on the outer peripheral surface; a plurality of second conductive layers formed on the plurality of inner peripheral surfaces; a third conductive layer formed on the second end face for short-circuiting the first and second conductive layers; a depressed part formed by removing a portion of the first conductive layer on the side of the first end face or a portion of the first conductive layer including the dielectric block; a dielectric substrate having a plurality of capacitance forming electrodes for forming capacitances between the electrodes and the second conductive layers and external connection means formed thereon and mounted on the depressed part; and reactance means provided on the dielectric substrate for coupling the capacitance forming electrodes to each other.

According to the above described first and second embodiments, the capacitance forming electrodes provided on the dielectric substrate form antiresonance capacitances between the electrodes and the second conductive layers, and the reactance element for coupling the capacitance forming electrodes is provided on the dielectric substrate, thereby to obtain a small-sized dielectric filter which can be easily manufactured.

Furthermore, a dielectric filter according to a third embodiment of the present invention comprises a plurality of coaxial resonators, each of the above described coaxial resonators comprising a dielectric block having an outer peripheral surface and an inner peripheral surface parallel to a common axis and having first and second end faces crossing the common axis, first and second conductive layers coating the outer peripheral surface and the inner peripheral surface, a third conductive layer formed on the second end face for short-circuiting the first and second conductive layers, and a depressed part formed by removing a portion of the first conductive layer on the side of the first end face or a portion of the first conductive layer including the dielectric block; and a dielectric substrate having a plurality of electrodes for external connection formed on its one major surface and having a plurality of ground electrodes corresponding to the external connection electrodes and electrically insulated from one another formed on the other major surface and mounted on the depressed part with the one major surface being abutted thereon.

Furthermore, a dielectric filter according to a fourth embodiment of the present invention comprises a dielectric block having an outer peripheral surface and a plurality of inner peripheral surfaces parallel to a common axis and having first and second end faces crossing the common axis; a first conductive layer formed on the outer peripheral surface; a plurality of second conductive layers formed on the plurality of inner peripheral surfaces; a third conductive layer formed on the second end face for short-circuiting the first and second conductive layers; a depressed part formed by removing a portion of the first conductive layer on the side,of the first end face or a portion of the first conductive layer including the dielectric block; and a dielectric substrate having a plurality of electrodes for external connection formed on its one major surface and having a plurality of ground electrodes corresponding to the external connection electrodes and electrically insulated from one another formed on the other major surface and mounted on the depressed part with the one major surface being abutted thereon.

In the above described dielectric filters according to the third and fourth embodiments, the plurality of ground electrodes formed on the dielectric substrate are electrically insulated from one another. Accordingly, all parts, excluding a reflected part of power which is not coupled to the coaxial resonator on the input side flow into the ground, resulting in no input-output direct coupling.

Furthermore, in a dielectric filter according to a fifth embodiment of the present invention which comprises a plurality of coaxial resonators each having an outer peripheral conductor and an inner peripheral conductor formed by coating an outer peripheral surface and an inner peripheral surface of a dielectric member with a conductive member and having one end face short-circuited, at least one of the plurality of coaxial resonators has a length different from those of the other coaxial resonators, and has the same basic resonance frequency as those of the other coaxial resonators by a resonance frequency correcting capacitance connected to the inner peripheral conductor.

In the above described dielectric filter according to the fifth embodiment, even if the basic resonance frequencies of the plurality of coaxial resonators are the same by the resonance frequency correcting capacitance, the coaxial resonators differ in length and thus, differ in higher resonance frequency component. Consequently, it is possible to achieve a small-sized dielectric filter in which pass characteristics in a resonance frequency in a higher TEM mode are restrained and spurious filter characteristics are improved without complicating a circuit.

Furthermore, an antenna duplexer according to the present invention comprises a filter for reception and a filter for transmission each comprising a plurality of coaxial resonators each having an outer peripheral conductor and an inner peripheral conductor formed by coating an outer peripheral surface and an inner peripheral surface of a dielectric member with a conductive member and having one end face short-circuited, and having a depressed part formed by removing a portion of the outer peripheral conductor on the open face side or a portion of the outer peripheral conductor including the dielectric member; and a dielectric substrate having a plurality of capacitance forming electrodes for forming capacitances between the electrodes and the inner peripheral conductors of the coaxial resonators, a reactance element for coupling the capacitance forming electrodes, and a matching circuit on the reception side and a matching circuit on the transmission side for connecting the filter for reception and the filter for transmission to one antenna formed thereon, each of the filter for reception and the filter for transmission being constructed by mounting the depressed part of the plurality of coaxial resonators at positions where the capacitance forming electrodes corresponding to the inner peripheral conductors of the coaxial resonators are formed on the dielectric substrate.

In the antenna duplexer according to the present invention, the matching circuits can be simultaneously provided on the dielectric substrate comprising the capacitance forming electrodes of both the filters, thereby simplifying the construction and easing manufacture.

Furthermore, another antenna duplexer according to the present invention comprises a filter for reception and a filter for transmission each including coaxial resonators each having one end face short-circuited, which has an outer peripheral conductor and inner peripheral conductors formed by providing a dielectric member with at least two holes and coating an outer peripheral surface of the dielectric member and inner peripheral surfaces of the through holes with a conductive member and has a depressed part formed by removing a portion of the outer peripheral conductor on the open face side or a portion of the outer peripheral conductor including the dielectric member; and a dielectric substrate having a plurality of capacitance forming electrodes for forming capacitances between the electrodes and the inner peripheral conductors, a reactance element for coupling the capacitance forming electrodes, and a matching circuit on the reception side and a matching circuit on the transmission side for connecting the filter for reception and the filter for transmission to one antenna, each of the filter for reception and the filter for transmission being constructed by mounting the depressed part on positions where the capacitance forming electrodes corresponding to the inner peripheral conductors are formed on the dielectric substrate.

Additionally, in still another antenna duplexer according to the present invention having a dielectric filter for reception and a dielectric filter for transmission, one ends of both the dielectric filters being connected to an antenna shared terminal, the antenna shared terminal, the one end of the filter for reception, and the one end of the filter for transmission are respectively grounded through capacitive elements or inductive elements, and the above described antenna shared terminal is connected to the one end of the filter for reception through the capacitive element or the inductive element, while being connected to the one end of the filter for transmission through the capacitive element or the inductive element.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
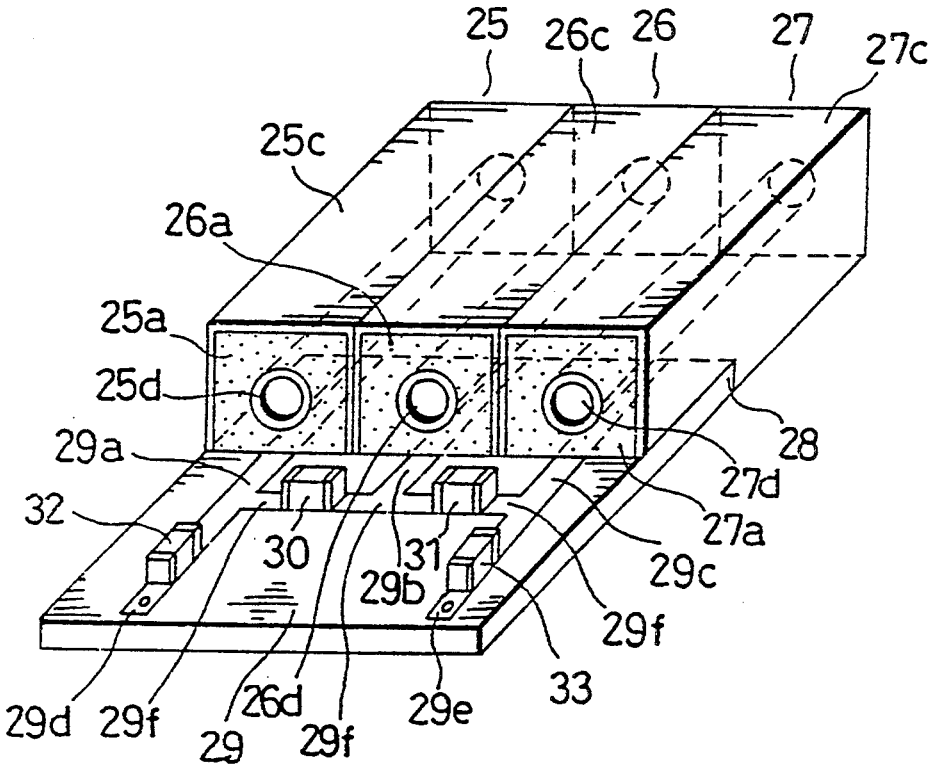
FIG. 1 is a perspective view showing the appearance of a dielectric filter according to a first embodiment of the present invention.

FIG. 1 is a diagram showing a first embodiment of the present invention, showing an example in which three coaxial resonators 25 to 27 constitute a band-pass filter having a pole in the rejection range. Each of the coaxial resonators 25 to 27 is a one-end face short-circuited type coaxial resonator in which an outer peripheral surface of a dielectric member (dielectric constant of 40) of a $TiO_2$—$SnO_2$—$ZrO_2$ system provided with a through hole and an inner peripheral surface of the through hole are coated with a conductive member such as silver. Sides of the resonator in cross section perpendicular to the longitudinal direction are respectively 3 mm and the length of the resonator in the longitudinal direction is 4.8 mm. The coaxial resonators 25 to 27 are provided with a depressed part 28 formed by removing a portion of outer peripheral conductors **25*c* to 27*c* including dielectric members 25*a* to 27*a*** to a depth of approximately 0.5 mm on the open end side.

Figure 2:
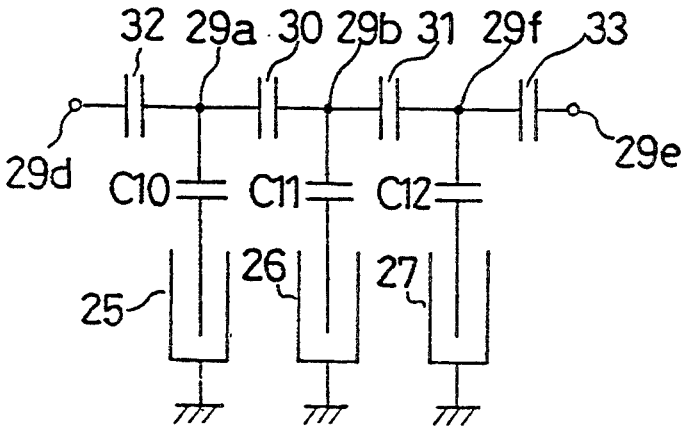
FIG. 2 is a diagram showing an equivalent circuit of the dielectric filter according to the first embodiment of the present invention.

A dielectric substrate 29 made of alumina is mounted on the depressed part 28. Capacitance forming electrodes **29*a* to 29*c*, input-output electrodes 29*d* and 29*e*, and an interstage coupling electrode 29*f* are formed on the upper surface of the dielectric substrate 29. The capacitance forming electrodes 29*a* to 29*c* are opposed to inner peripheral conductors 25*d* to 27*d* through the dielectric members when the dielectric substrate 29 is mounted on the depressed part 28 of the coaxial resonators 25 to 27, to form antiresonance capacitances C10 to C12 as shown in FIG. 2. The values of the antiresonance capacitances C10 to C12 are determined by, for example, the areas of the capacitance forming electrodes 29*a* to 29*c*, and the distance between the inner peripheral conductors 25*d* to 27*d* and the capacitance forming electrodes 29*a* to 29*c*. The larger the values of the antiresonance capacitances C10 to C12** are, the deeper an attenuation pole in filter characteristics is formed and the larger the difference between the resonance frequency and the antiresonance frequency is.

Chip capacitors 30 to 33 are provided in predetermined places between the above described electrodes **29*a* to 29*e* formed on the upper surface of the dielectric substrate 29. The chip capacitors 30 and 31 are used as interstage coupling capacitors respectively connected to the interstage coupling electrode 29*f* so as to couple the coaxial resonators 25 and 26 and 26 and 27. The chip capacitors 32 and 33 are used as input coupling capacitors respectively connected between the input-output electrodes 29*d* and 29*e* and the capacitance forming electrodes 29*a* and 29*c***.

The input-output electrodes **29*d* and 29*e* are subjected to through-hole plating, and are connected to input-output stab electrodes (not shown) provided on the reverse surface of the dielectric substrate 29** by penetration.

Figure 3:
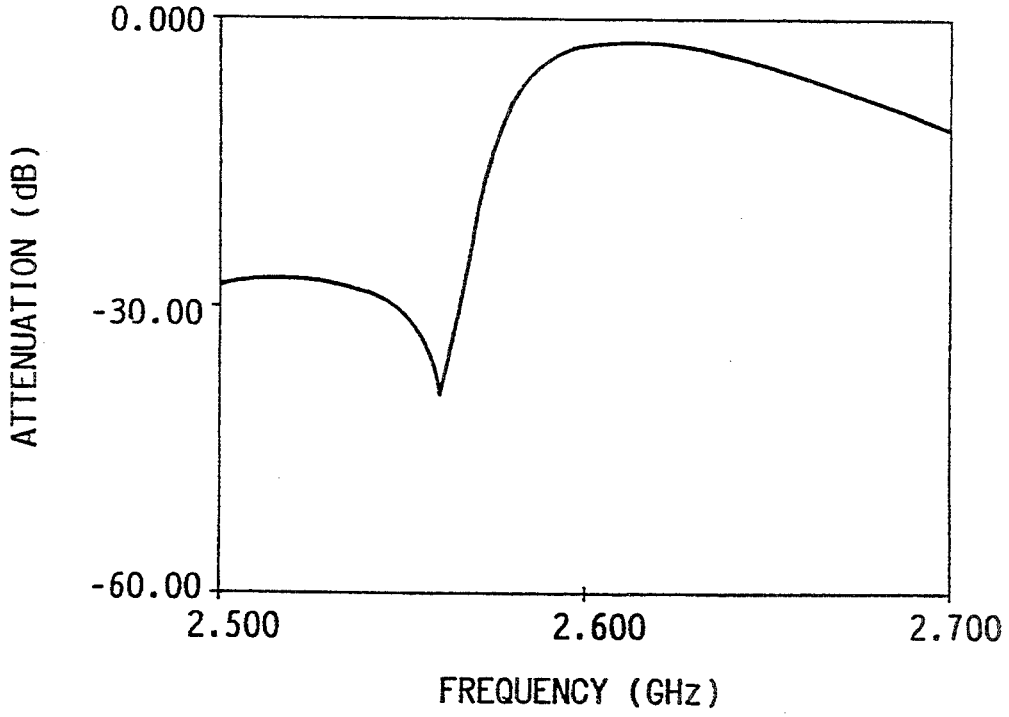
FIG. 3 is a diagram showing the frequency characteristics of the dielectric filter according to the first embodiment of the present invention.

The dielectric filter thus constructed is shown in FIG. 2 as represented by an equivalent circuit, and filter characteristics having an attenuation pole on the low frequency side of a passband as shown in FIG. 3 are obtained. In the dielectric filter, the antiresonance capacitances are respectively formed between the inner peripheral conductors of the coaxial resonators and the capacitance forming electrodes formed on the dielectric substrate, and the capacitance forming electrodes are coupled to each other by a reactance element constituted by the interstage coupling capacitors 30 and 31, so that the respective resonators are coupled to each other to have frequency characteristics having an attenuation pole. Moreover, since the capacitance forming electrodes are coupled to each other by the reactance element constituted by the interstage coupling capacitors 30 and 31, an input-output direct coupling which is achieved through a ground electrode due to the fact that the grounding of the ground electrode is in an incomplete state is prevented. Consequently, the degradation of out-of-band attenuation can be restrained in the frequency characteristics of the filter.

Figure 4:
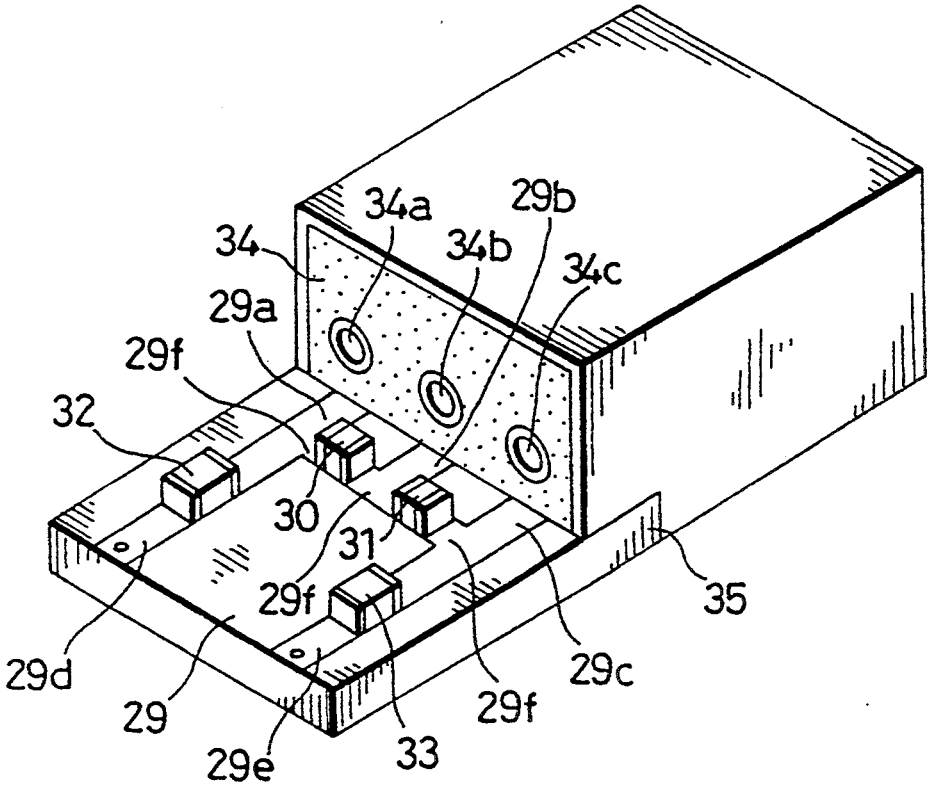
FIG. 4 is a diagram showing the appearance of a dielectric filter according to a second embodiment of the present invention.

FIG. 4 is a diagram showing a second embodiment of the present invention, showing an example of a dielectric filter including a plurality of coaxial resonators each having one end face short-circuited, which has an outer peripheral conductor and inner peripheral conductors formed by providing a dielectric member 34 with a plurality of through holes 34*a* to 34*c* and coating an outer peripheral surface of the dielectric member 34 and inner peripheral surfaces of the through holes with a conductive member. A depressed part 35 is formed by removing a portion of the outer peripheral conductor on the open face side of the coaxial resonators or a portion of the outer peripheral conductor including the dielectric member, and a dielectric substrate 29*a* which is the same as that in the above described first embodiment is mounted on the depressed part 35.

Figure 5A:
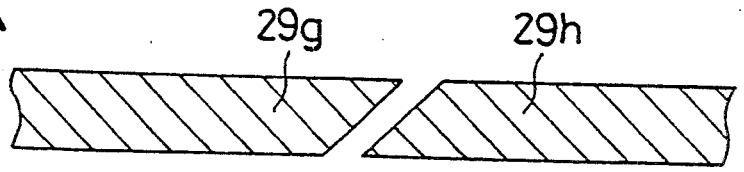
FIGS. 5A to 5F are schematic diagrams showing a capacitance portion formed on a dielectric substrate according to the present invention.
Figure 5B:
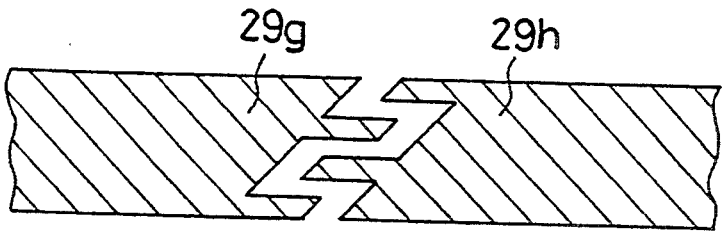

Although in the above described first and second embodiments, the chip capacitors are used as a capacitance element provided on the dielectric substrate, the structures shown in FIGS. 5A to 5F can be also used. More specifically, in FIGS. 5A and 5B, a pair of electrodes 29*g* and 29*h* having ends opposed to each other with predetermined spacing which is formed on a dielectric substrate 29 constitute a capacitance. In FIG. 5B, each of electrodes 29*g* and 29*h* is formed in an interdigital shape, so that it is possible to form a larger capacitance than that shown in FIG. 5A.

Figure 5C:
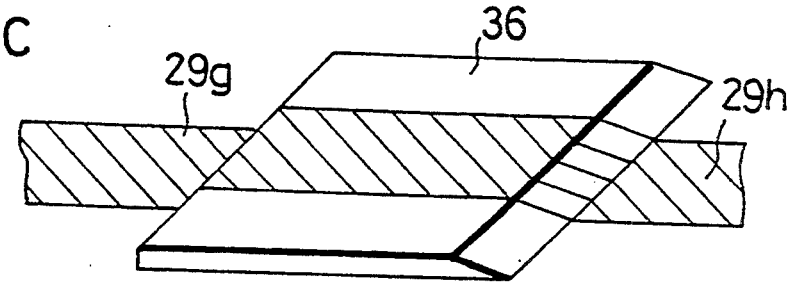
Figure 5D:
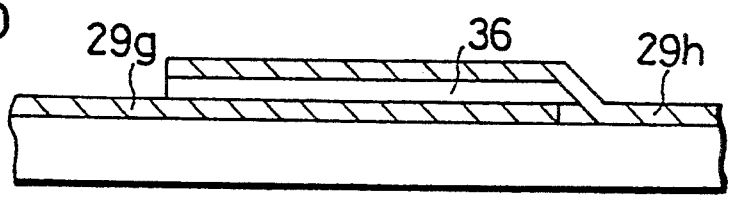
Figure 5E:
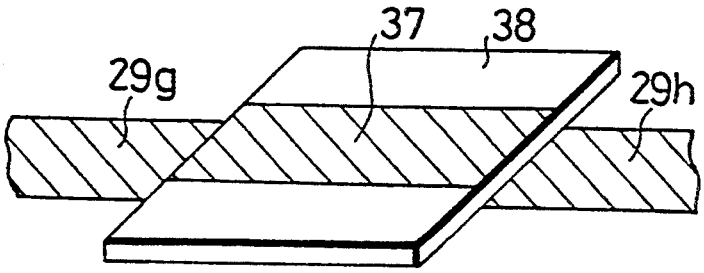
Figure 5F:
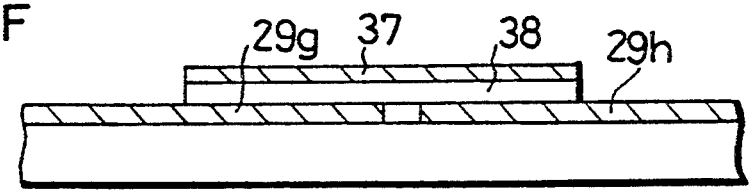

In FIGS. 5C and 5D. a dielectric piece 36 is disposed in an end of one of electrodes 29*g* and the other electrode 29*h* extends to the upper surface of the dielectric piece 36, to form a capacitance. FIG. 5C is a perspective view, and FIG. 5D is a cross sectional view. In FIGS. 5E and 5F, a dielectric piece 38 having an electrode 37 provided on its upper surface is disposed on the upper surfaces of the electrodes shown in FIG. 5A, to form a capacitance. FIG. 5E is a perspective view, and FIG. 5F is a cross sectional view.

Figure 6:
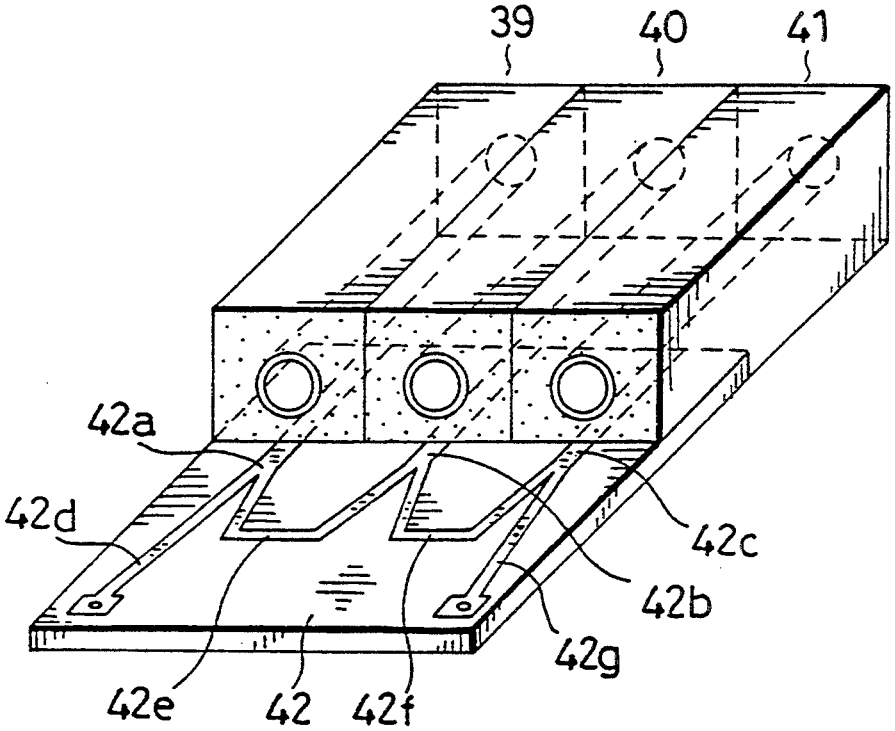
FIG. 6 is a perspective view showing the appearance of a dielectric filter according to a third embodiment of the present invention.

FIG. 6 is a diagram showing a third embodiment of the present invention, showing an example in which three coaxial resonators 39 to 41 are used to construct a band-rejection filter.

Figure 7:
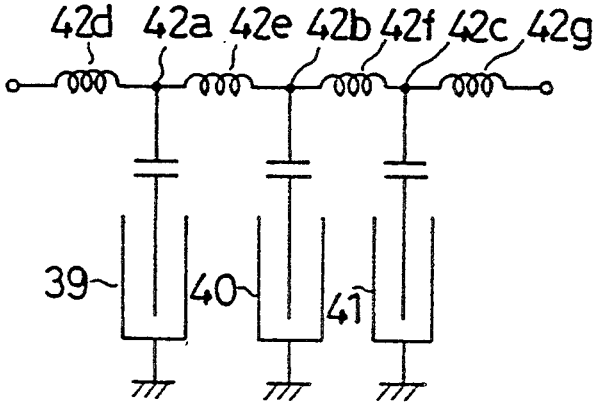
FIG. 7 is a diagram showing an equivalent circuit of the dielectric filter according to the third embodiment of the present invention.
Figure 8:
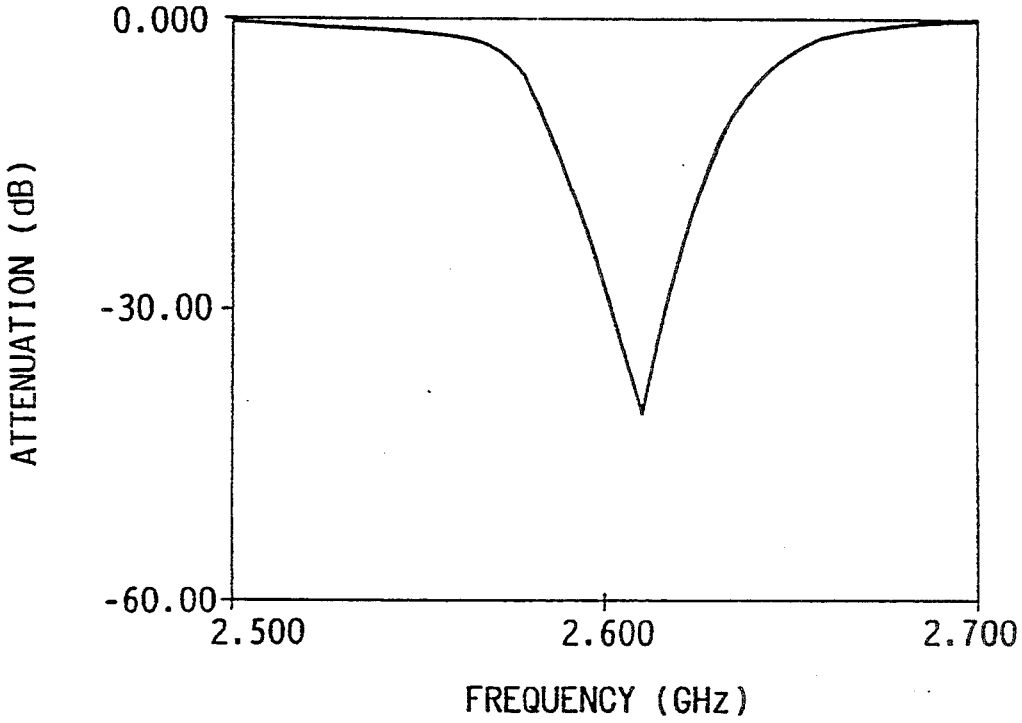
FIG. 8 is a diagram showing the frequency characteristics of the dielectric filter according to the third embodiment of the present invention.

Pattern inductors 42*d* to 42*g* connected to capacitance forming electrodes 42*a* to 42*c* are formed on a dielectric substrate 42. This dielectric filter is shown in FIG. 7 as represented by an equivalent circuit, and the filter characteristics thereof are band preventing characteristics having an attenuation pole as shown in FIG. 8.

Figure 9A:
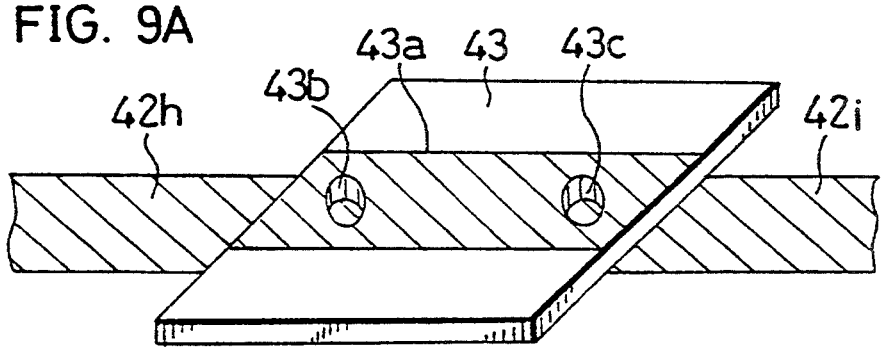
FIGS. 9A and 9B are schematic diagrams showing an inductance formed on a dielectric substrate in the present invention.
Figure 9B:
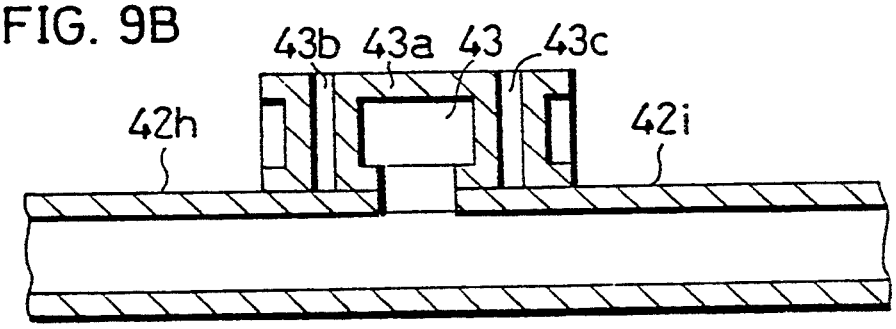

Although in the third embodiment, the pattern inductors 42*d* to 42*g* formed on the dielectric substrate 42 are used as an inductance element, the structures shown in FIGS. 9A and 9B can be used. As shown in a perspective view of FIG. 9A and a cross sectional view of FIG. 9B, an electrode 43*a* is formed on the upper surface of a pair of electrodes 42*h* and 42*i* opposed to each other with predetermined spacing which is provided on the dielectric substrate 42, and a dielectric piece 43 having a pair of plated-through holes 43*b* and 43*c* connected to each other is connected to the electrode 43*a*.

In the above described first to third embodiments, the capacitance forming electrodes are coupled to each other by the reactance element constituted by the interstage coupling capacitors 30 and 31. Accordingly, an input-output direct coupling which is achieved through a ground electrode due to the fact that the grounding of the ground electrode is in an incomplete state is prevented. Consequently, it is possible to restrain the degradation of out-of-band attenuation in the frequency characteristics of the filter.

Figure 32A:
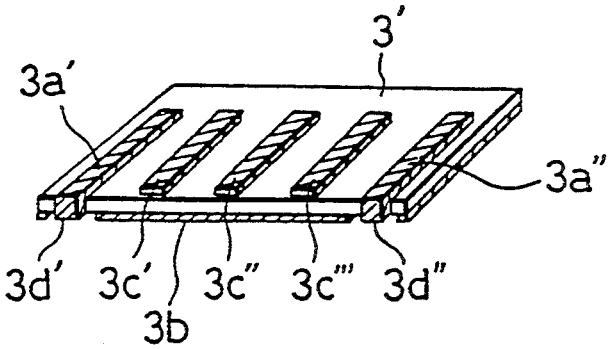
FIG. 32A PRIOR ART
FIG. 32A is a perspective view showing a dielectric substrate in the conventional dielectric filter.
Figure 32B:
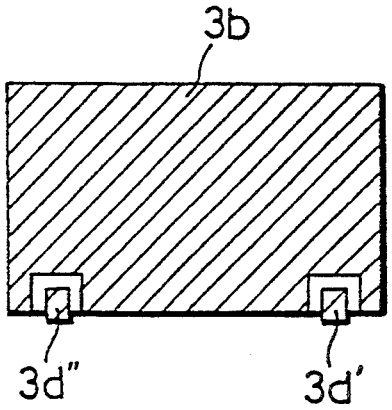
FIG. 32B PRIOR ART
FIG. 32B is a bottom view showing the dielectric substrate in the conventional dielectric filter.
Figure 32C:
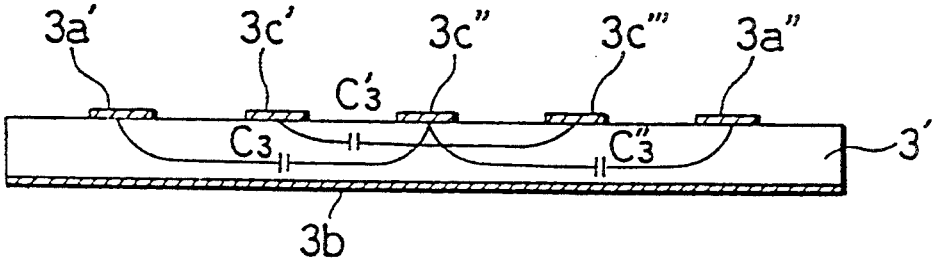
FIG. 32C PRIOR ART
FIG. 32C is a transverse sectional view showing the dielectric substrate in the conventional dielectric filter.
Figure 33:
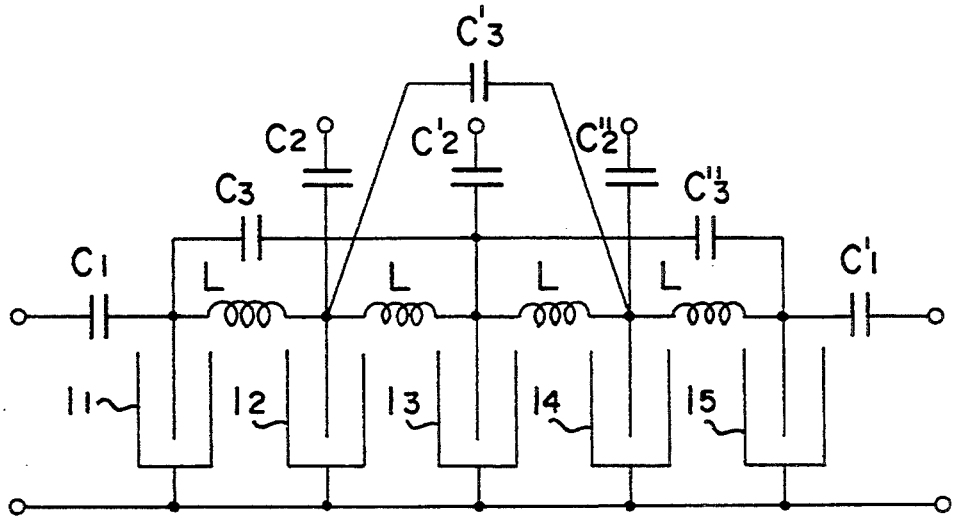
FIG. 33 PRIOR ART
FIG. 33 is a diagram showing an equivalent circuit of the conventional dielectric filter.
Figure 34:
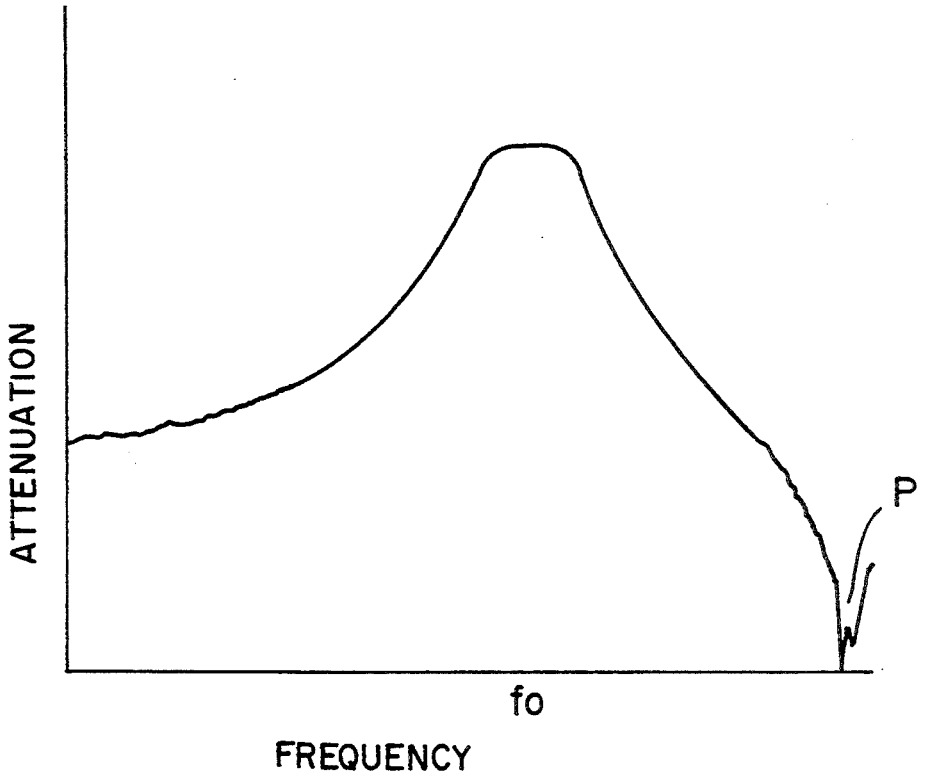
FIG. 34 PRIOR ART
FIG. 34 is a diagram showing the frequency characteristics of the conventional dielectric filter.

In a dielectric filter used for forming a pole P in an attenuation region of filter characteristics by jump capacitances C3, C'3 and C''3 as shown in FIG. 32, however, when the grounding of a ground electrode 3*b* on a dielectric substrate 3' is incomplete, a capacitive coupling is achieved through the ground electrode 3*b* between connection electrodes 3*d'* and 3*d''*, to significantly degrade the filter characteristics. Particularly in a microwave band of not less than 10 GHz, it is difficult to obtain complete grounding, so that out-of-band attenuation is significantly degraded in the frequency characteristics of the filter.

In fourth to sixth embodiments, an input-output direct coupling which is achieved through a ground electrode due to the fact that the grounding of the ground electrode is in an incomplete state is prevented in a dielectric filter used for forming a pole P in an attenuation region of filter characteristics by a jump coupling.

FIG. 10 is a diagram showing a fourth embodiment of the present invention, showing an example in which a first coaxial resonator 50 and a second coaxial resonator 51 constitute a dielectric filter. The first coaxial resonator 50 is one on the input side, and the second coaxial resonator 51 is one on the output side. The first and second coaxial resonators 50 and 51 are respectively provided with depressed parts 52 and 52', and a dielectric substrate 53 having an input connection electrode 53*a* and an output connection electrode 53*a'* shown in FIG. 10D is mounted on the depressed parts 52 and 52', so that the connection electrodes 53*a* and 53*a'* are respectively coupled to inner peripheral conductors 50*d* and 51*d'* of the coaxial resonators 50 and 51.

Furthermore, a coupling (interstage coupling) between the coaxial resonators 50 and 51 is achieved by joining windows (not shown) formed by removing portions of respective outer peripheral conductors 50*c* and 51*c* of the coaxial resonators 50 and 51 to each other.

Figure 10A:
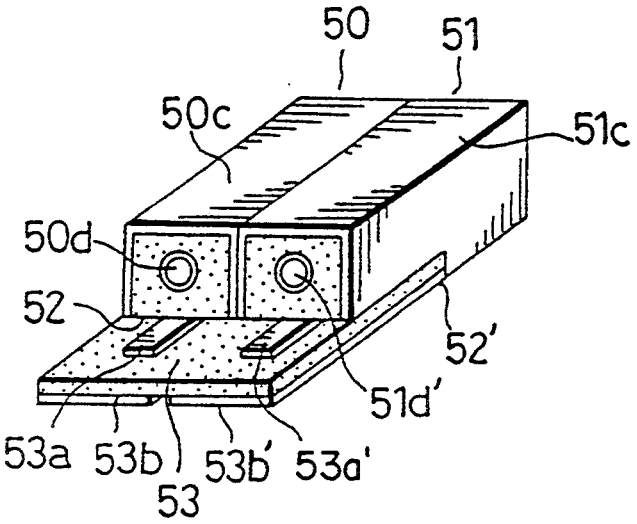
FIG. 10A is a perspective view showing the appearance of a dielectric filter according to a fourth embodiment of the present invention.
Figure 10B:
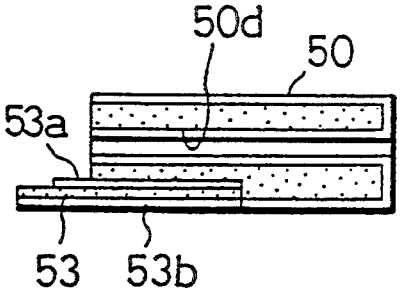
FIG. 10B is a transverse sectional view showing the dielectric filter according to the fourth embodiment of the present invention.
Figure 10C:
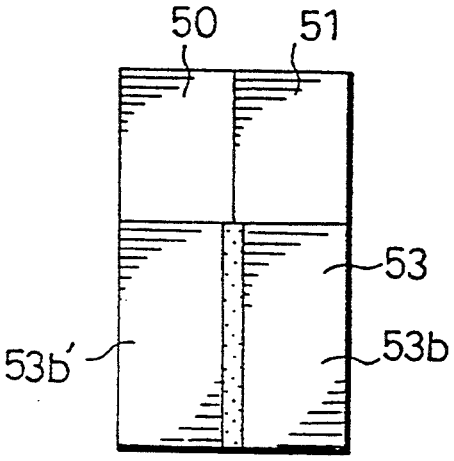
FIG. 10C is a bottom view showing the dielectric filter according to the fourth embodiment of the present invention.
Figure 10D:
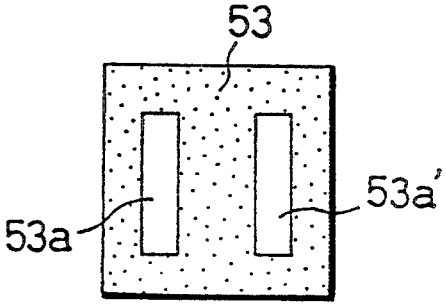
FIG. 10D is a plane view showing a dielectric substrate in the fourth embodiment of the present invention.

As shown in a bottom view of FIG. 10C, first and second ground electrodes 53*b* and 53*b'* are respectively formed on the reverse surface of the dielectric substrate 53 corresponding to the input-output connection electrodes 53*a* and 53*a'*. The spacing between the first and second ground electrodes 53*b* and 53*b'* is substantially a distance at which the electrodes are not coupled to each other and the ingress of noise is prevented, for example, 0.2 mm.

Figure 11:
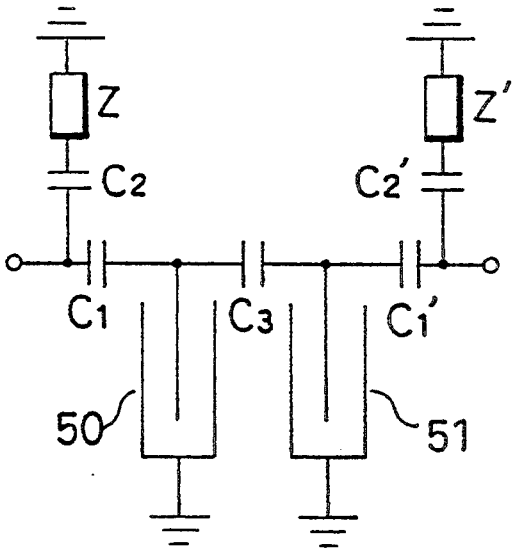
FIG. 11 is a diagram showing an equivalent circuit of the dielectric filter according to the fourth embodiment of the present invention.

FIG. 11 is a diagram showing an equivalent circuit of the dielectric filter according to the fourth embodiment, where C1 and C1' indicate coupling capacitances respectively formed between the inner peripheral conductors 50*d* and 51*d'* of the coaxial resonators 50 and 51 and the connection electrodes 53*a* and 53*a'* on the dielectric substrate 53, C2 and C2' indicate capacitances respectively formed between the connection electrodes 53*a* and 53*a'* and the first and second ground electrodes 53*b* and 53*b'*, C3 indicates an interstage coupling capacitance, and Z and Z' indicate impedance components which occur when the grounding of the ground electrodes 53*b* and 53*b'* is incomplete.

Figure 12:
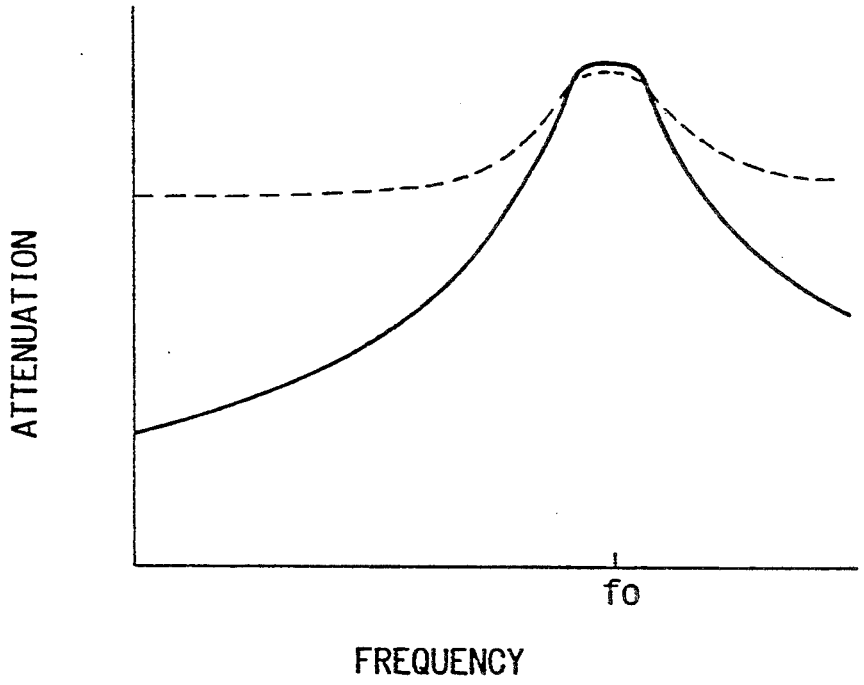
FIG. 12 is a diagram showing the frequency characteristics of the dielectric filter according to the fourth embodiment of the present invention.
Figure 31A:
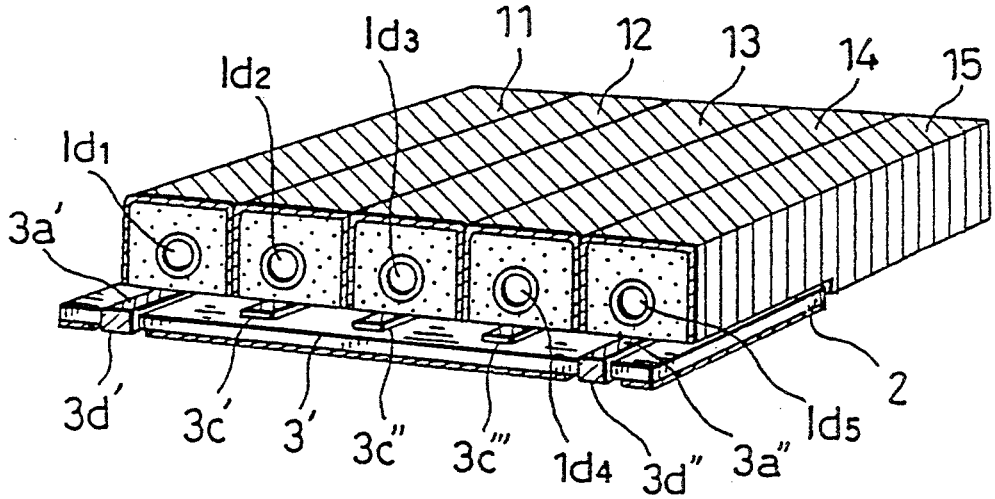
FIG.31A PRIOR ART
FIG. 31A is a perspective view showing the appearance of a conventional dielectric filter.
Figure 31B:
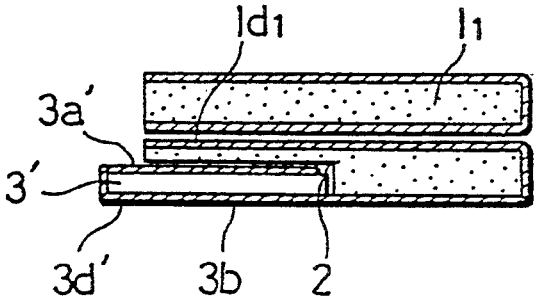
FIG.31B PRIOR ART
FIG. 31B is a transverse sectional view showing the conventional dielectric filter.

FIG. 12 is a diagram showing the frequency characteristics of the dielectric filter according to the fourth embodiment, where a broken line represents the frequency characteristics of a dielectric filter laving a structure shown in FIG. 31. As can be seen from the characteristic diagram, an input-output direct coupling is prevented by dividing a ground electrode formed on the reverse surface of the dielectric substrate 53, to improve the out-of-band attenuation characteristics of the filter.

Figure 13A:
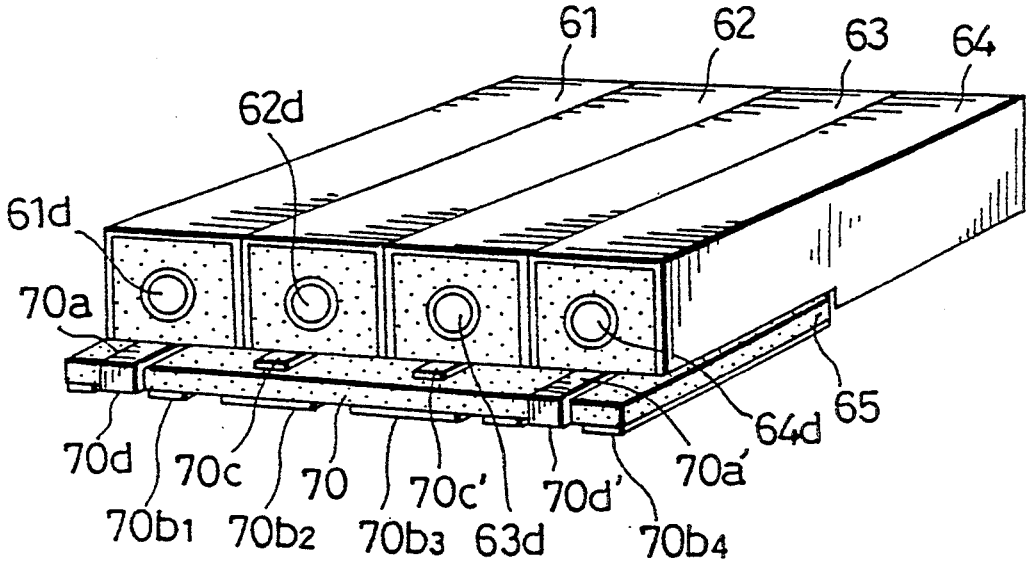
FIG. 13A is a perspective view showing the appearance of a dielectric filter according to a fifth embodiment of the present invention.
Figure 13B:
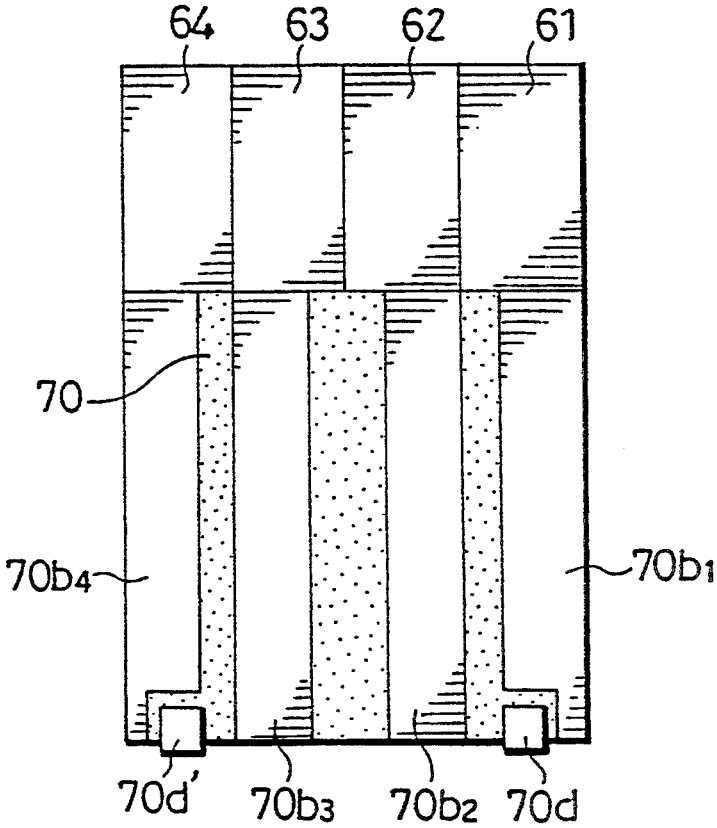
FIG. 13B is a bottom view showing the dielectric filter according to the fifth embodiment of the present invention.

FIG. 13 is a diagram showing a fifth embodiment of the present invention, showing an example in which four coaxial resonators 61 to 64 constitute a filter. FIG. 13A is a perspective view, and FIG. 13B is a bottom view. The resonators 61 to 64 are provided with a depressed part 65, and a dielectric substrate 70 is mounted on the depressed part 65. The resonators 61 to 64 are coupled to each other through coupling windows (not shown).

Input-output connection electrodes 70*a* and 70*a'* and capacitance forming electrodes 70*c* and 70*c'* are respectively formed on the upper surface of the dielectric substrate 70, and stab electrodes for external connection 70*d* and 70*d'* formed by extending the input-output connection electrodes 70*a* and 70*a'* and ground electrodes $\mathbf{70}b_1$ to $\mathbf{70}b_4$ in positions corresponding to the connection electrodes 70*a* to 70*a'* and the capacitance forming electrodes 70*c* and 70*c'* are formed on the lower surface thereof.

Figure 14:
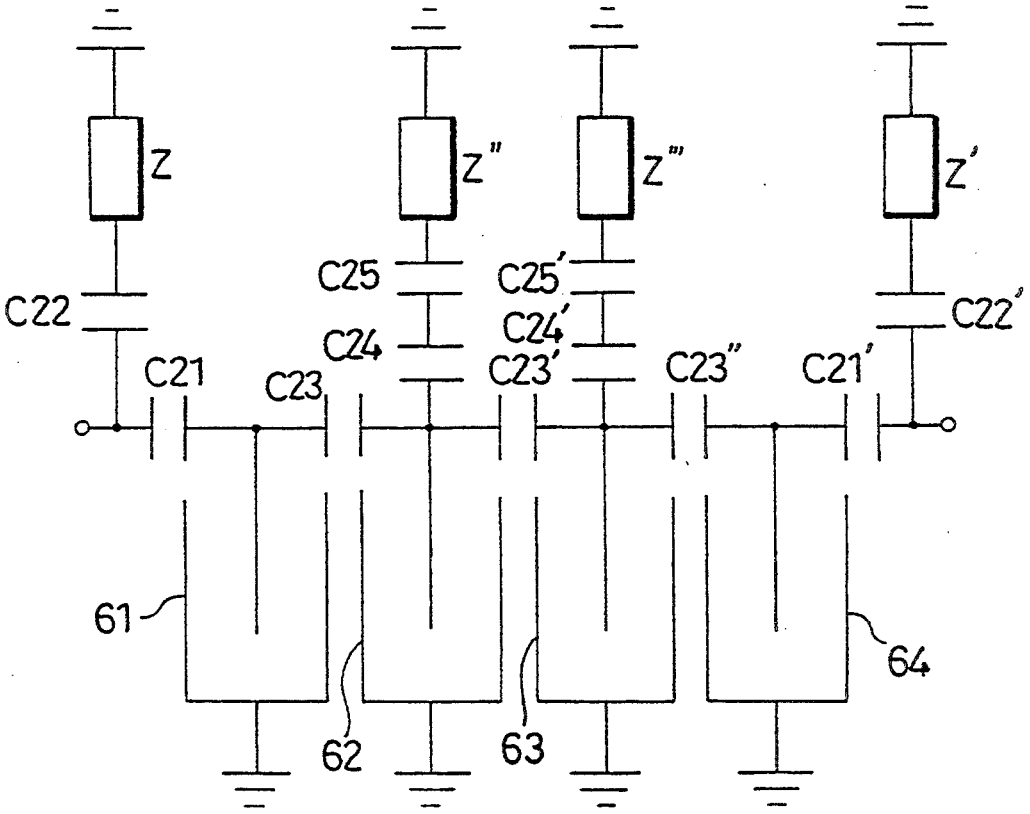
FIG. 14 is a diagram showing an equivalent circuit of the dielectric filter according to the fifth embodiment of the present invention.

Input-output coupling capacitances C21 and C21' are respectively formed between the input-output connection electrodes 70*a* and 70*a'* and inner peripheral conductors 61*d* and 64*d* of the coaxial resonators 61 and 64, and resonator length correcting capacitances C24 and C24' are respectively formed between the capacitance forming electrodes 70*c* and 70*c'* and the inner peripheral conductors 62*d* and 63*d* of the coaxial resonators 62 and 63, as shown in FIG. 14.

FIG. 14 shows an equivalent circuit of the dielectric filter according to the fifth embodiment. In the circuit diagram of FIG. 14, C23, C23' and C23" indicate interstage coupling capacitances, and C25 and C25' indicate capacitances respectively formed between the capacitance forming electrodes 70C and 70C' and the ground electrodes $\mathbf{70}b_2$ and $\mathbf{70}b_3$.

In the fifth embodiment, when a pole P is formed in an attenuation region of filter characteristics, the resonators are connected through a transmission line with at least one resonator being skipped. For example, the input-output connection electrode 70 and the capacitance forming electrode 70*c'* and/or the input-output connection electrode 70*a'* and the capacitance forming electrode 70*c* may be connected to each other through a transmission line in a skipped manner.

Figure 15A:
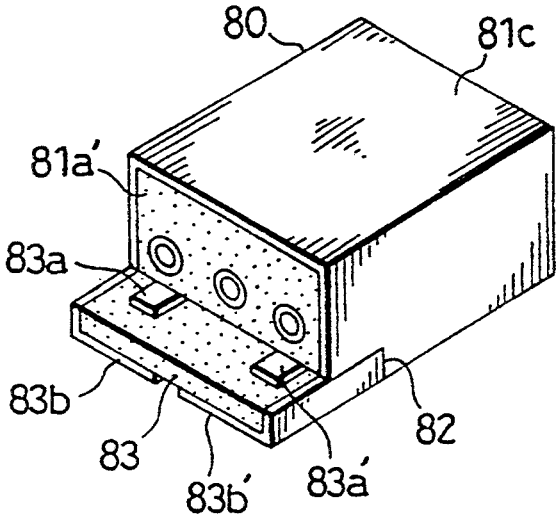
FIG. 15A is a perspective view showing the appearance of a dielectric filter according to a sixth embodiment of the present invention.
Figure 15B:
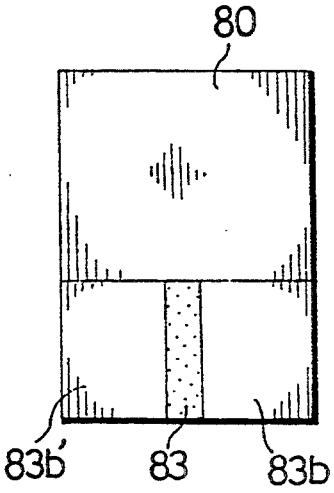
FIG. 15B is a bottom view showing the dielectric filter according to the sixth embodiment of the present invention.

FIG. 15 is a diagram showing a sixth embodiment of the present invention, showing an example of a dielectric filter including a plurality of coaxial resonators each having one end face short-circuited, which has an outer peripheral conductor 81*c* and inner peripheral conductors formed by providing a dielectric member with a plurality of through holes 81*b*, 81*b'* and 81*b"* and coating an outer peripheral surface of the dielectric member and inner peripheral surfaces of the through holes with a conductive member.

In the sixth embodiment, a depressed part 82 is formed by removing a portion of the outer peripheral conductor on the open face side of the coaxial resonators or a portion of the outer peripheral conductor including the dielectric member, and a dielectric substrate 83 having external connection electrodes 83*a* and 83*a'* and ground electrodes 83*b* and 83*b'* separated in a substantially central part is mounted on the depressed part 82, to construct a dielectric filter.

When capacitance forming electrodes are formed on the dielectric substrate in the sixth embodiment, as in the fifth embodiment, a ground electrode provided on the reverse surface is divided corresponding to the capacitance forming electrodes.

When a pole P is formed in an attenuation region of filter characteristics in the sixth embodiment, the external connection electrodes 83*a* and 83*a'* are respectively connected to each other through a transmission line, so that the resonators are connected to each other with one resonator being skipped.

According to the fourth to sixth embodiments, the plurality of ground electrodes formed on the reverse surface of the dielectric substrate having at least the external connection electrodes which is mounted on the depressed part of the coaxial resonators are provided separated from each other corresponding to the external connection electrodes and the capacitance forming electrodes. Accordingly, an input-output direct coupling is prevented, thereby making it possible to improve out-of-band attenuation in the frequency characteristics of the filter without degrading the noise shielding effect.

Meanwhile, as the above described dielectric filter using the coaxial resonators, a filter using quarter wavelength type resonators which resonate at a wavelength which is one-fourth the wavelength in the resonance frequency by short-circuiting the one sides of the resonators.

For example, it is assumed in the dielectric filter shown in FIG. 10 that ceramics of a $TiO_2$—$ZrO_2$—$SnO_2$ system is used as a material for the coaxial resonators, and the dielectric constant $\epsilon r$ thereof is 40. If the length of one side of each of the coaxial resonators in cross section perpendicular to the longitudinal direction is 3 mm, the diameter of the through hole is 0.8 mm, and the length l of the resonator is 4.6 mm, a characteristic impedance $z_0$ is 12Ω.

In such a dielectric filter, impedances are matched as viewed from the input side in a particular frequency band, to exhibit the characteristics of a band-pass filter.

The resonance conditions of the quarter wavelength type resonator are given by the following equation (1):

$$Z_0 \cdot \tan(\beta \cdot l) = \infty \quad (1)$$

(where $\beta$ is a propagation constant in the resonator)

Furthermore, the length l of the resonator is given by the following equation (2) when c is taken as the speed of light:

$$l = c/(4f_0\epsilon r^{\frac{1}{2}}) \quad (2)$$

From the equation (2), the following equation is obtained:

$$f_0 = c/(4l_0\epsilon r^{\frac{1}{2}}) \quad (3)$$

Consequently, the resonance frequencies of the coaxial resonators 50 and 51 shown in FIG. 10 are 2.6 GHz.

Figure 16:
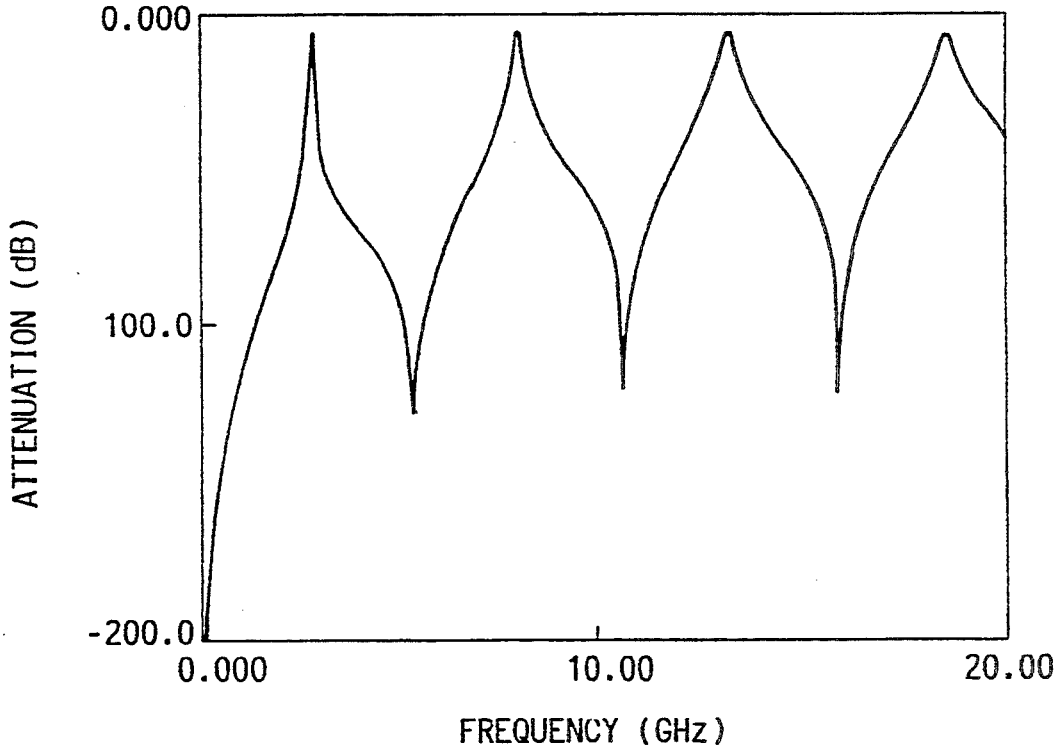
FIG. 16is a diagram showing the frequency characteristics of the dielectric filter according to the fourth embodiment of the present invention.

Meanwhile, a resonator constituting a filter may, in some cases, generally exhibit undesired filter characteristics because it has not less than two resonance modes. For example, in order to make the length of the quarter wavelength type resonator the smallest, a basic TEM mode is generally utilized. However, there exists a higher TEM mode having a resonance frequency which is an odd order of the frequency in the basic TEM mode. In the dielectric filter shown in FIG. 10, the resonance frequency in the basic TEM mode is 2.6 GHz. At this time, the resonance frequency in the higher TEM mode exists in the vicinity of 7.8, 13.0 and 18.2 GHz. FIG. 16 shows the frequency characteristics of the dielectric filter shown in FIG. 10. The reason why large resonance characteristics appear in the resonance frequency in the higher TEM mode is that resonance frequencies of the coaxial resonators 50 and 51 in the higher TEM mode are equal, so that they are mutually reinforcing.

Thus, spurious filter characteristics having a center frequency in the vicinity of a frequency which is an odd multiple of the center frequency of desired filter characteristics appear. Such spurious filter characteristics exert various adverse effects on microwave equipments. For example, when such unnecessary filter characteristics exist in a filter on the reception side, a microwave in another band enters a circuit. In addition, when such unnecessary filter characteristics exist in a filter on the transmission side, a microwave having a frequency other than the intrinsic center frequency is released in a space.

In a seventh embodiment and an eighth embodiment, there is provided a small-sized dielectric filter in which spurious filter characteristics in a resonance frequency in a higher TEM mode can be solved without complicating a circuit.

Figure 17:
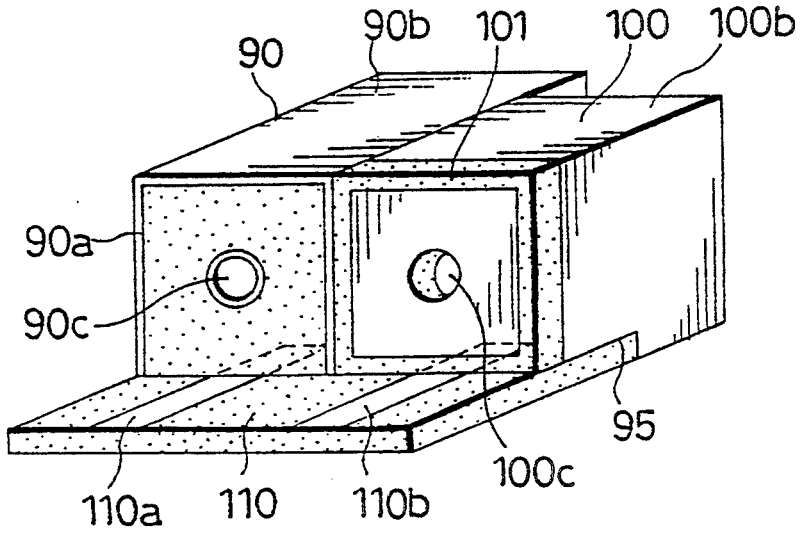
FIG. 17 is a perspective view showing the appearance of a dielectric filter according to a seventh embodiment of the present invention.

FIG. 17 and FIG. 18 are a diagram showing a dielectric filter according to the seventh embodiment of the present invention. In one-end face short-circuited type coaxial resonators 90 and 100, an outer peripheral surface of a dielectric member provided with through holes and inner peripheral surfaces of the through holes, excluding their open faces 90*a* and 100*a*, are coated with a conductive member such as silver. A material for the resonators is ceramics of a $TiO_2$—$ZrO_2$—$SnO_2$ system, and the dielectric constant thereof is 40.

Figure 18A:
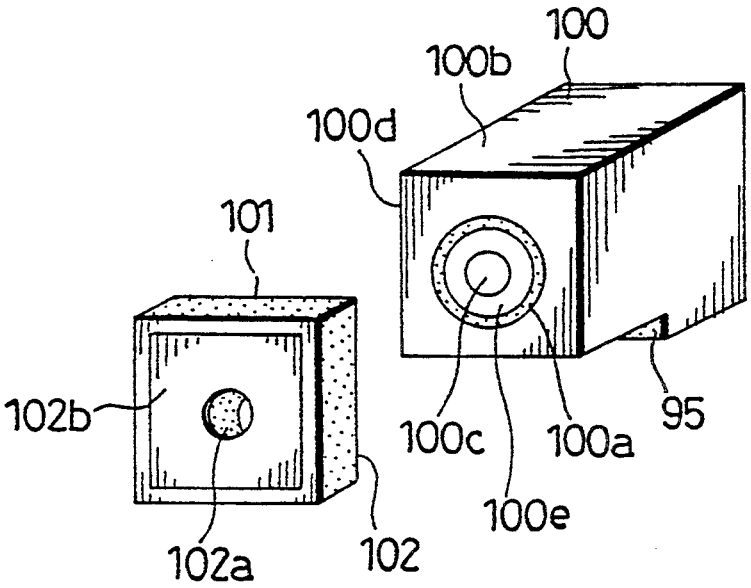
FIG. 18A is an exploded perspective view showing a resonator comprising a coaxial resonator and a capacitance forming portion in the seventh embodiment of the present invention.
Figure 18B:
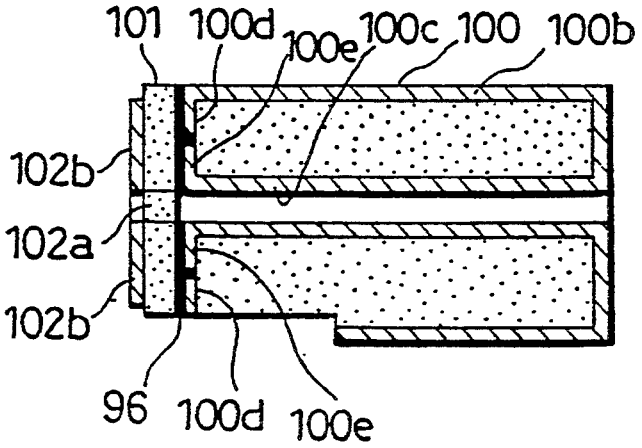
FIG. 18B is a transverse sectional view showing the resonator comprising the coaxial resonator and the capacitance forming portion in the seventh embodiment of the present invention.

The coaxial resonator 90 is the same as that shown in FIG. 10, and the resonance frequency thereof is 2.6 GHz. A capacitance forming portion 101 is mounted on the open face 100*a* of the coaxial resonator 100. FIG. 18A is an exploded perspective view of a coaxial resonator 100 and a capacitance forming portion 101, and FIG. 18B shows a transverse sectional view thereof.

The length of one side of the coaxial resonator 100 in cross section perpendicular to the longitudinal direction is 3 mm, the diameter of the through hole is 0.8 mm, and the length of the resonator is 2.3 mm.

A first conductor 100*d* electrically connected to an outer peripheral conductor 100*b* and a second conductor 100*e* electrically connected to an inner peripheral conductor 100*c* are formed on the open face 100*a* of the coaxial resonator 100.

The capacitance forming portion 101 comprises a dielectric member 102 in the shape of a square pole having a bottom surface which is almost the same as the open face 100*a* of the coaxial resonator 100. The dielectric material thereof can be the same as that of the coaxial resonator or another dielectric material. The dielectric member 102 is provided with a through hole 102*a*, and is provided with a capacitance forming conductor 102*b* on its one surface. A surface, on which the capacitance forming conductor 102*b* is not formed, of the capacitance forming portion 101 is mounted on the open face 100*a* of the coaxial resonator 100 by an adhesive or a dielectric paste 96. The capacitance forming conductor 102*b* on the capacitance forming portion 101 respectively forms resonance frequency correcting capacitances C31 and C32 shown in FIG. 19 between the capacitance forming conductor 102*b* and the first conductor 100*d* and the second conductor 100*e* on the open face 100*a* of the coaxial resonator 100.

The resonance frequency of the resonator comprising the coaxial resonator 100 and the capacitance forming portion 101 is set to 2.6 GHz which is the same as that of the coaxial resonator 90. Therefore, a combined capacitance C of the resonance frequency correcting capacitances C31 and C32 is set to 5 pF. The combined capacitance C is found from the following equation (4) showing the resonance conditions of the resonator:

$$Zo \cdot \tan(\beta 1) = 1/(2\pi f_0 C) \quad (4)$$

The resonance frequency of the resonator in a higher TEM mode appears in the vicinity of 11.1, 21.0 and 31.2 GHz. On the other hand, the coaxial resonators 90 and 100 differ in length, so that the resonance frequency of the coaxial resonator 90 in a higher TEM mode appear in the vicinity of 7.8, 13.0 and 18.2 GHz, which differs from the above described one. Consequently, their respective higher-order harmonic components are not added to each other, so that undesired filter characteristics are restrained.

Meanwhile, the coaxial resonators 90 and 100 are provided with a depressed part 95, similarly to the dielectric filter shown in FIG. 10, and a dielectric substrate 110 having external connection electrodes 110*a* and 110*b* formed thereon is mounted on the depressed part 95. Input-output coupling capacitances C33 and C34 are respectively formed between the external connection electrodes 110*a* and 110*b* and the inner peripheral conductors 90C and 100C of the coaxial resonators 90 and 100. In addition, the coaxial resonators 90 and 100 are coupled to each other through coupling windows (not shown) formed on the outer peripheral conductors.

Figure 19:
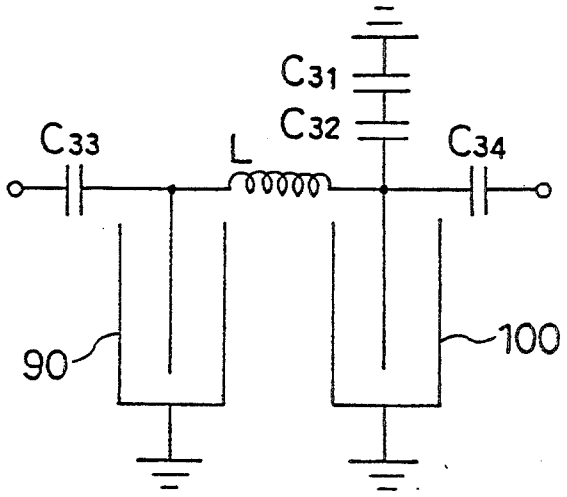
FIG. 19 is a diagram showing an equivalent circuit of the dielectric filter according to the seventh embodiment of the present invention.

FIG. 19 shows an equivalent circuit of the dielectric filter shown in FIG. 18. L indicates a coupling inductance between the resonators 90 and 100.

Figure 20:
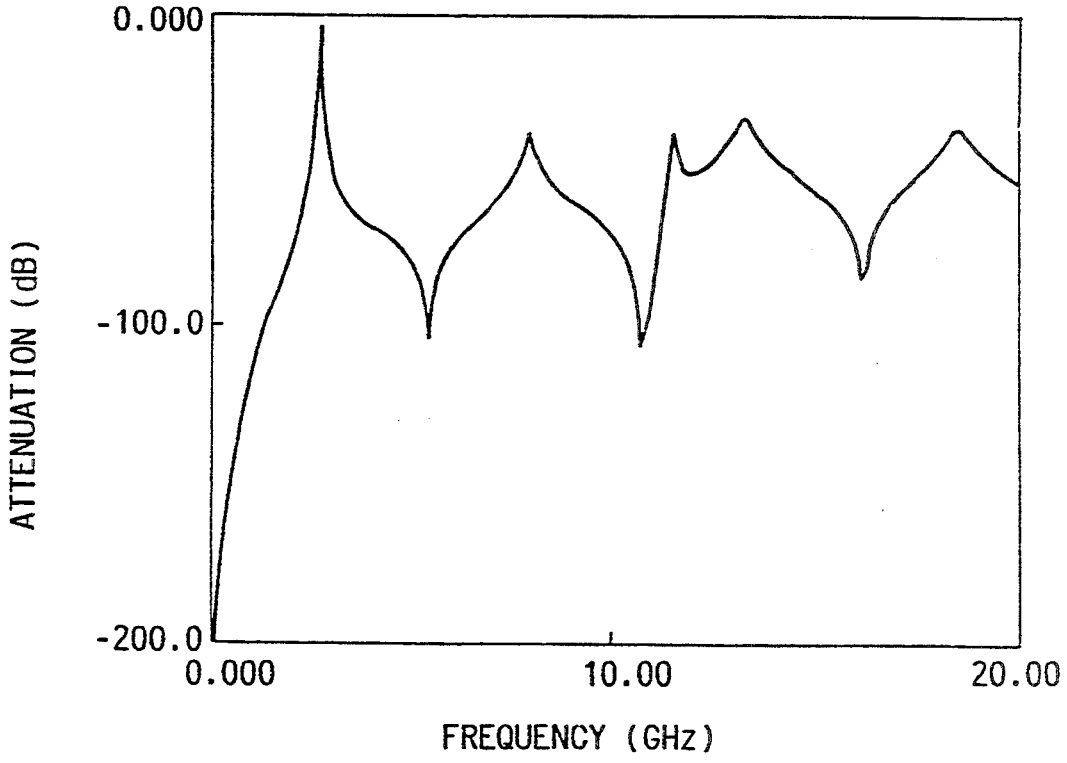
FIG. 20 is a diagram showing the frequency characteristics of the dielectric filter according to the seventh embodiment of the present invention.

FIG. 20 is a diagram showing the frequency characteristics of the dielectric filter shown in FIG. 18. As can be seen from the characteristic diagram, pass characteristics in the resonance frequency in the higher TEM mode are restrained, as compared with the frequency characteristics shown in FIG. 16.

Figure 21A:
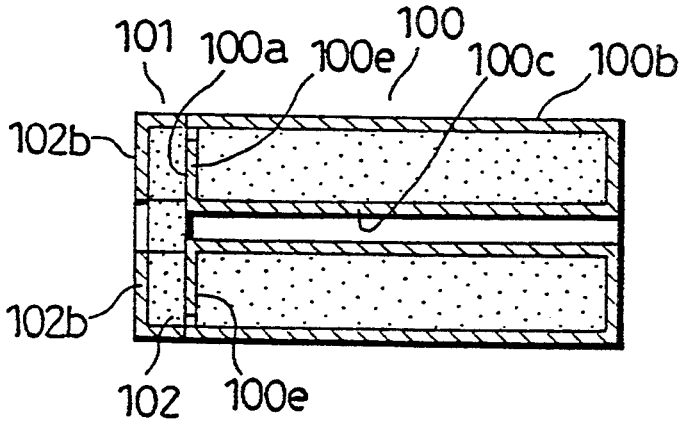
FIGS. 21A to 21C are cross sectional views showing a dielectric filter according to an eighth embodiment of the present invention.
Figure 21B:
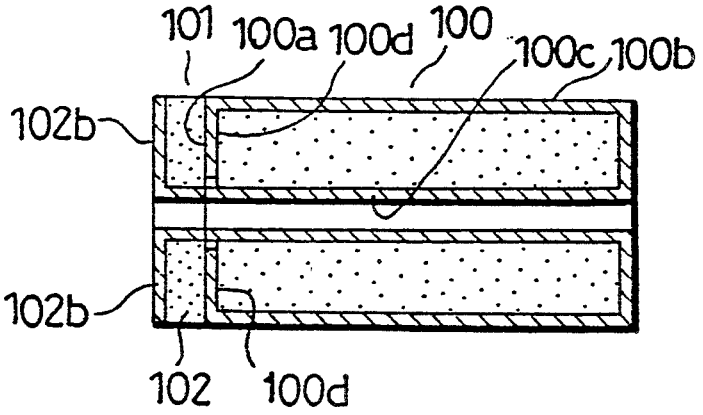
Figure 21C:
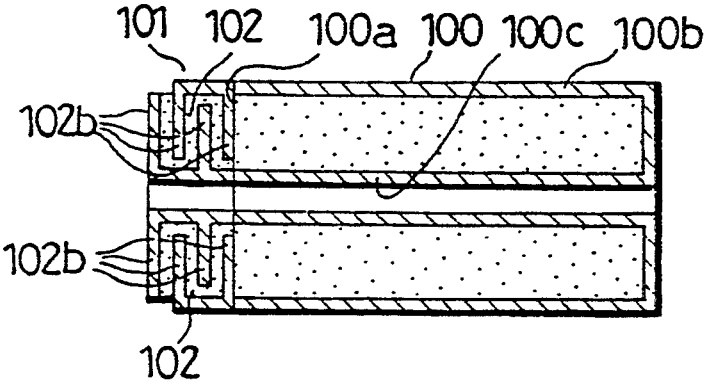

FIGS. 21A to 21C show an eighth embodiment, which are transverse sectional views showing examples in which the structures of a capacitance forming portion 101 mounted on a coaxial resonator 100 are different. A resonator shown in FIG. 21A is constructed by forming a first conductor 100*e* electrically connected to an inner peripheral conductor 100*c* on an open face 100*a* of the coaxial resonator 100 and mounting a dielectric member 102 having a capacitance forming conductor 102*b* electrically connected to an outer peripheral conductor 100*b* formed therein on the open face 100*a* of the coaxial resonator 100.

A resonator shown in FIG. 21B is constructed by forming a first conductor 100*d* electrically connected to an outer peripheral conductor 100*b* on an open face 100*a* of a coaxial resonator 100 and mounting a dielectric member 102 having a capacitance forming conductor 102*b* electrically connected to an inner peripheral conductor 100*c* formed therein on the open face 100*a* of the coaxial resonator 100.

In a resonator shown in FIG. 21C, a plurality of capacitance forming conductors 102*b* are disposed with they being alternately opposed to each other in a capacitance forming portion 101, thereby to make it possible to form a large capacitance.

Although in the above described embodiment, resonance frequency correcting capacitances are connected to an inner peripheral conductor of only one of a pair of coaxial resonators, different capacitances may be connected to both the coaxial resonators so that the basic resonance frequencies of the coaxial resonators are equal. In such a manner, the lengths of both the coaxial resonators can be reduced, thereby to make it possible to make the filter small in size.

As described in the foregoing, according to the seventh and eighth embodiments, it is possible to achieve a small-sized dielectric filter in which pass characteristics in a resonance frequency in a higher TEM mode are restrained and undesired filter characteristics are improved without complicating a circuit.

Figure 22:
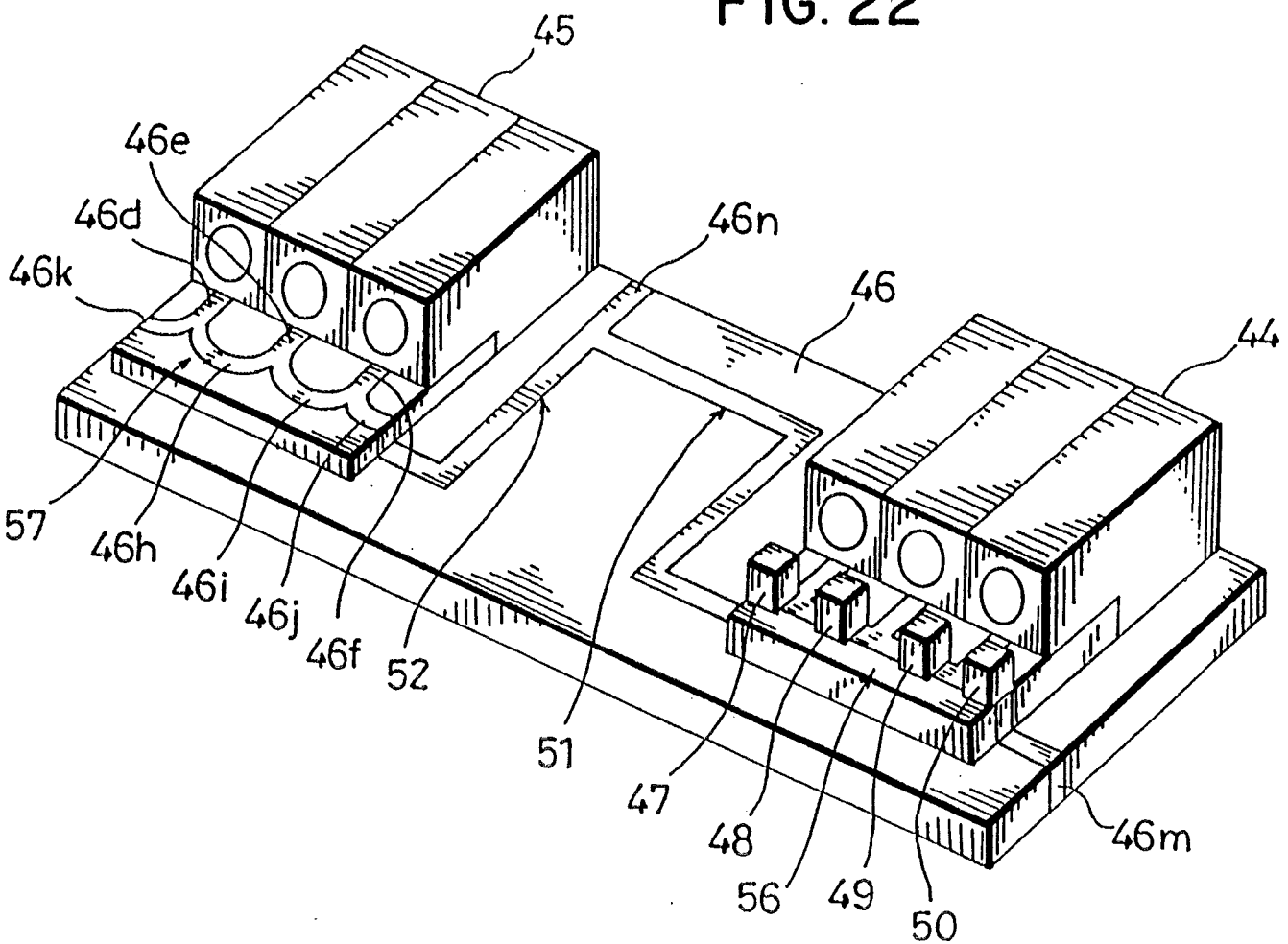
FIG. 22 is a perspective view showing the appearance of a antenna duplexer according to a ninth embodiment of the present invention.

FIG. 22 shows a ninth embodiment of the present invention, which is a perspective view showing a antenna duplexer using as a filter for reception (Rx) a band-pass filter having a pole in the rejection range 44 according to the first embodiment and using as a filter for transmission (Tx) a band-rejection filter 45 according to the third embodiment.

Figure 23:
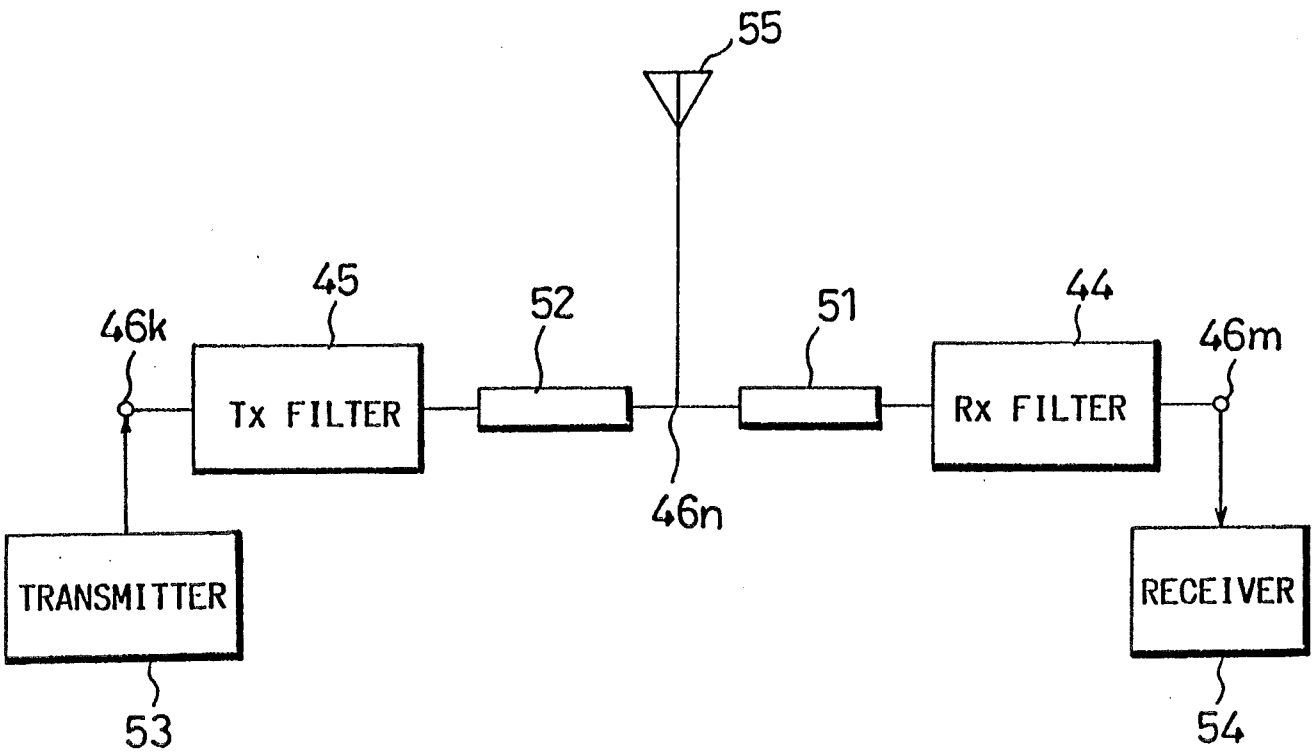
FIG. 23 is a schematic diagram showing an equivalent circuit of the antenna duplexer shown in FIG. 22.

Electrodes 46*a* to 46*c* for the above described band-pass filter having a pole in the rejection range 44, electrodes 46*d* to 46*f* for the band-rejection filter 45, and pattern inductors 46*g* to 46*j* are formed on the surface of a dielectric substrate 46 made of alumina having a ground electrode formed on its reverse surface, and chip capacitors 47 to 50 are disposed thereon. In addition, a matching circuit on the reception side 51 and a matching circuit on the transmission side 52 for connecting the filter for reception and the filter for transmission to one antenna. A Tx input electrode 46*k* connected to a transmitter 53, an Rx output electrode 46*m* connected to a receiver 54, and an antenna electrode 46*n* connected to an antenna 55 are formed, as shown in FIG. 23. FIG. 23 is a schematic diagram showing the antenna duplexer.

The filter for reception (Rx) has properties of passing a received wave band and preventing a transmitted wave band, and the filter for transmission (Tx) has properties of passing a transmitted wave band and preventing a received wave band.

Meanwhile, since an input impedance of the filter for reception (Rx) relative to a transmitted wave or an input impedance of the filter for transmission (Tx) relative to a received wave take a finite value, the impedances may, in some cases, be mismatched between both the filters and the antenna. Accordingly, the matching circuit on the reception side 51 and the matching circuit on the transmission side 52 for connecting the filters to one antenna are formed. In the present embodiment, the matching circuit on the reception side 51 and the matching circuit on the transmission side 52 are constructed using the change in phase due to a transmission line. More specifically, the phase of a signal wave varies depending on the length of the transmission line which is the length of the propagated distance. By selecting the length of the transmission line, the input impedance of the filter for transmission (Tx) in the received wave band is regarded as infinity, and the input impedance of the filter for reception (Rx) in the transmitted wave band is regarded as infinity. As a result, the antenna duplexer characteristics of a shared antenna are obtained.

In such a antenna duplexer, the matching circuits 51 and 52 for adjusting the characteristics of the filters 44 and 45 are formed on the same dielectric substrate 46, to decrease the number of components and make the manufacture easy.

Also in the ninth embodiment, a dielectric filter using coaxial resonators, which is formed by coating an outer peripheral surface of a dielectric member provided with a plurality of through holes and inner peripheral surfaces of the through holes with a conductive member as in the second embodiment, may be used as filters for transmission and reception.

Figure 24:
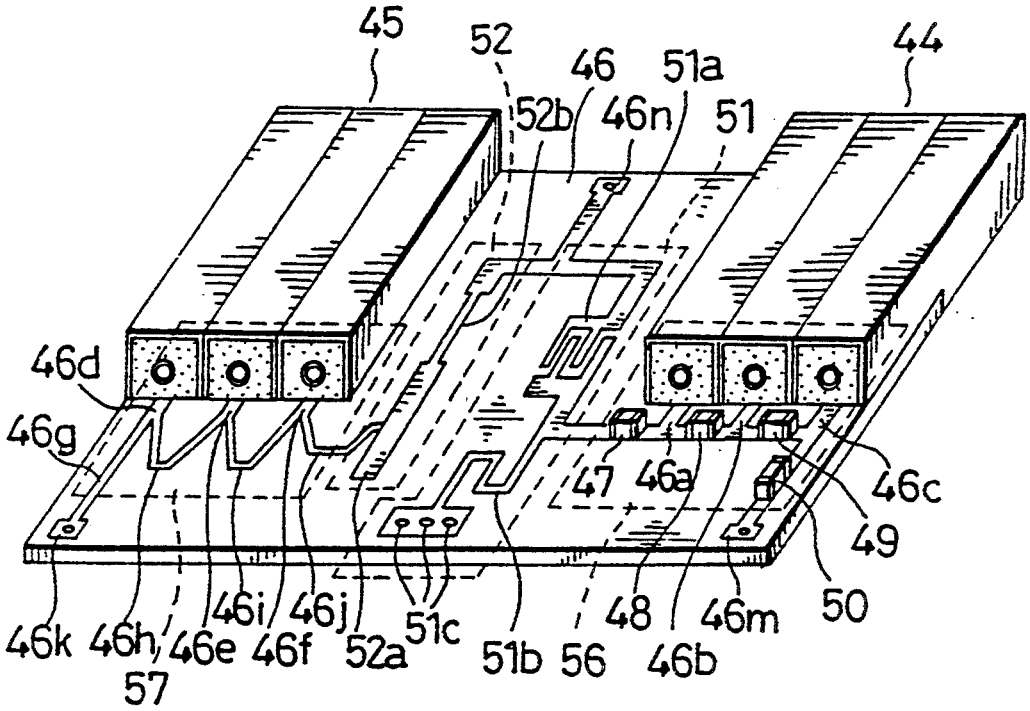
FIG. 24 is a perspective view showing the appearance of a antenna duplexer according to a tenth embodiment of the present invention.

FIG. 24 shows a tenth embodiment of the present invention, which is a perspective view showing a antenna duplexer using as a filter for reception (Rx) a band-pass filter having a pole in the rejection range 44 according to the first embodiment and using as a filter for transmission (Tx) a band-rejection filter 45 according to the third embodiment, as in the ninth embodiment.

The tenth embodiment is the same as the ninth embodiment except for the structures of a matching circuit on the reception side 51' and a matching circuit on the transmission side 52' for connecting the filter for reception and the filter for transmission to one antenna.

The matching circuit in the ninth embodiment is formed using the transmission line. In the matching circuit formed using the transmission line, however, the length of the line may be in the vicinity of a quarter wavelength in many cases, so that the matching circuit itself requires a large area, to increase the entire antenna duplexer in size. In the tenth embodiment, therefore, the matching circuit is constructed using an inductance element and a capacitance element, to decrease the matching circuit in size.

Figure 25:
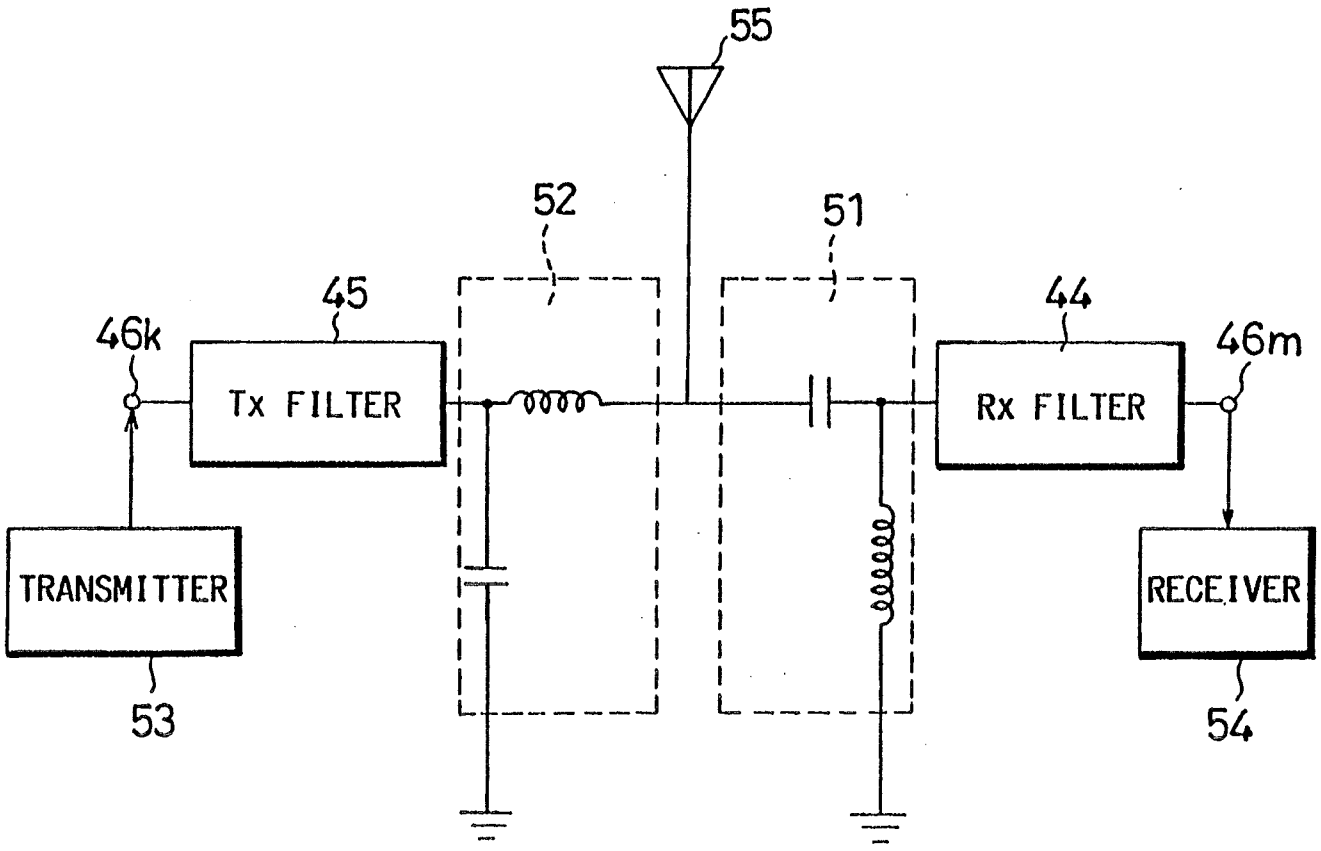
FIG. 25 is a schematic diagram showing an equivalent circuit of the antenna duplexer shown in FIG. 24.

Pattern capacitors 51*a* and 52*a* are used as the capacitance portions, and line inductors 51*b* and 52*b* are used as the inductance elements. The line inductor 51 is grounded to a ground electrode on the reverse surface through a plated-through hole 51*c*. FIG. 25 is a schematic diagram showing the antenna duplexer.

In such a antenna duplexer, circuits 56 and 57 for adjusting the characteristics of the filters 44 and 45 and matching circuits 51 and 52 can be formed on the same dielectric substrate 46, thereby to reduce the number of components and make the manufacture easy.

Also in the tenth embodiment, a dielectric filter using coaxial resonators, which is formed by coating an outer peripheral surface of a dielectric member provided with a plurality of through holes and inner peripheral surfaces of the through holes with a conductive member as in the second embodiment, may be used as filters for transmission and reception.

Figure 26:
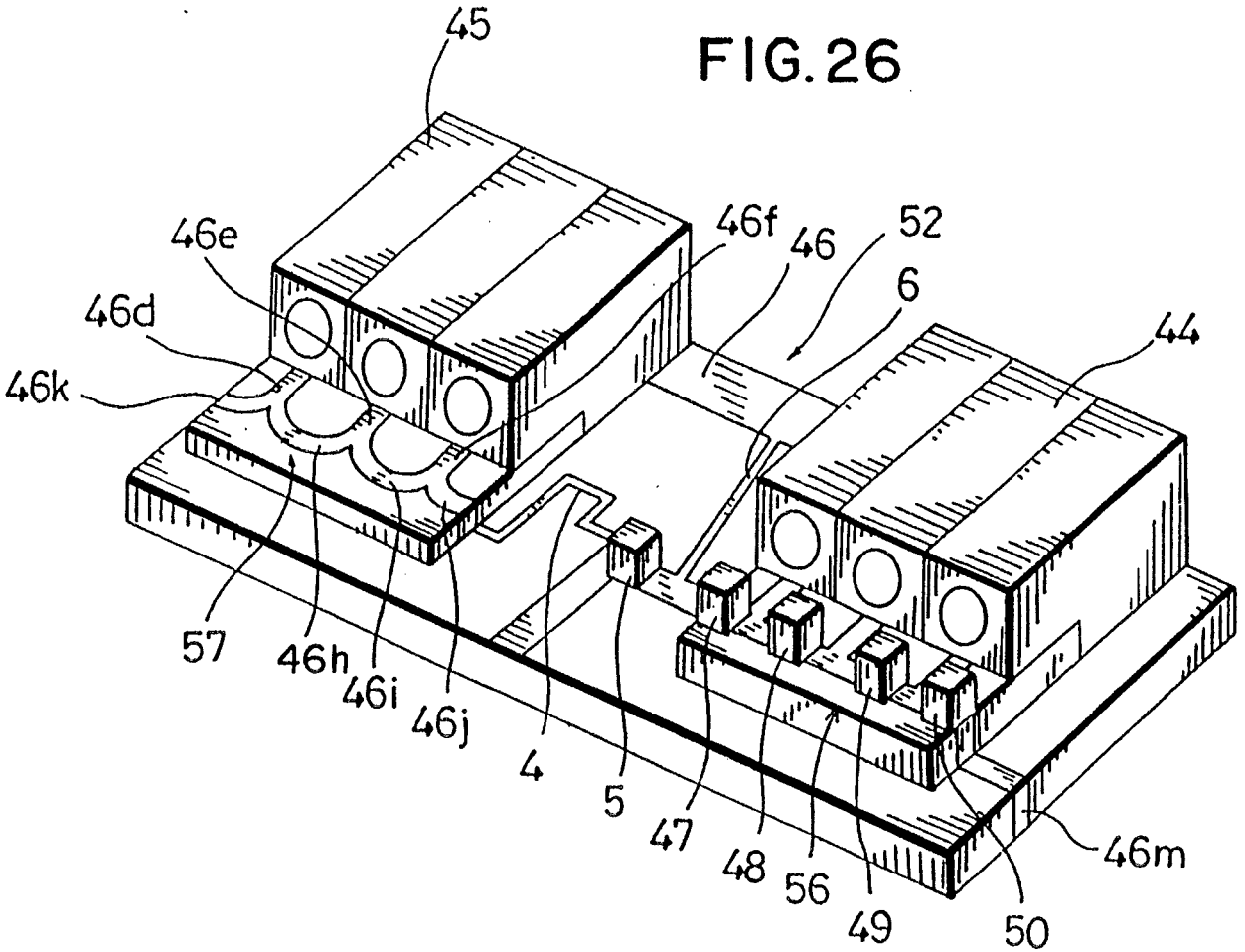
FIG. 26 is a perspective view showing the appearance of a antenna duplexer according to an eleventh embodiment of the present invention.
Figure 27:
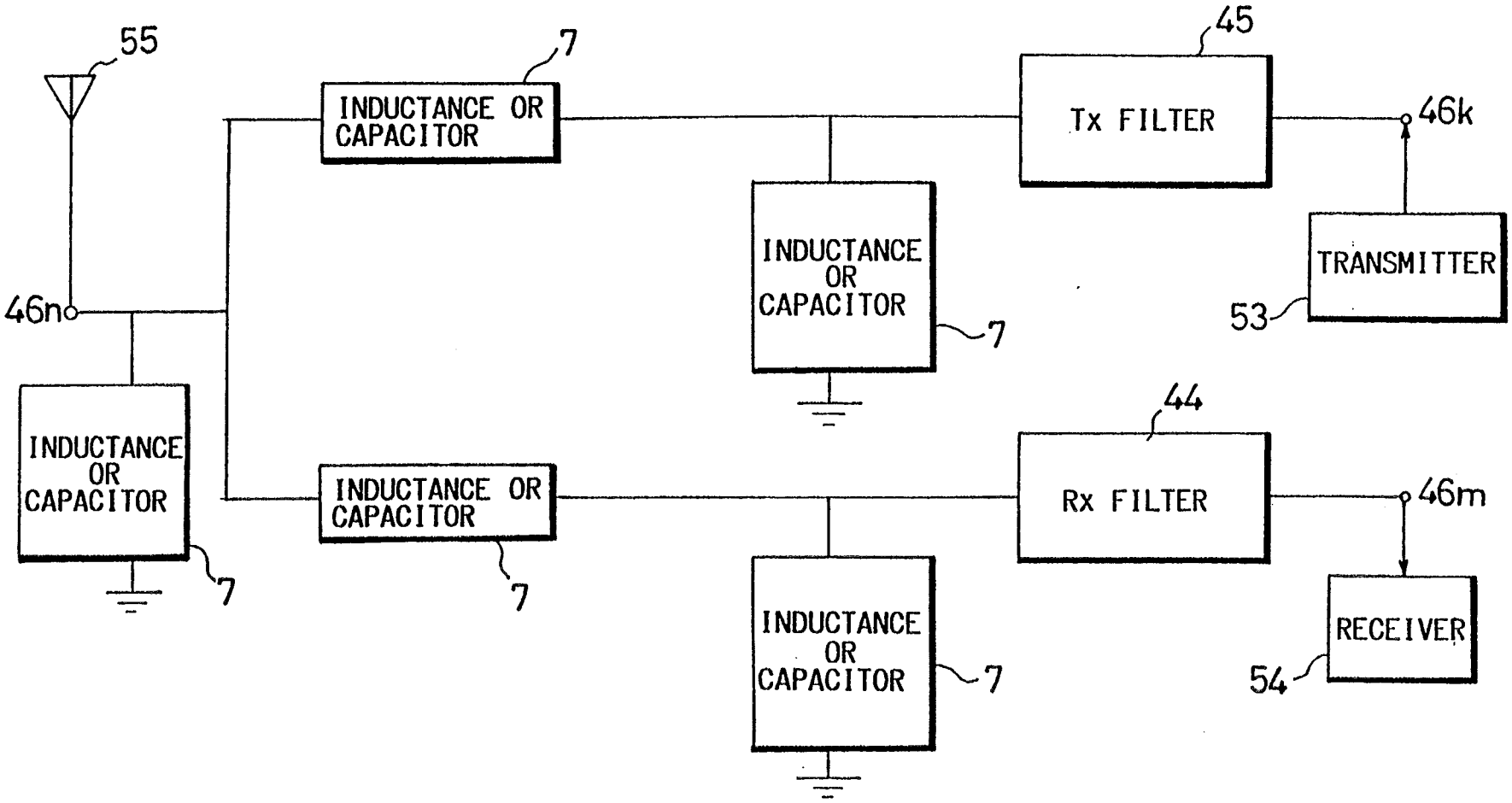
FIG. 27 is a schematic diagram showing an equivalent circuit of the antenna duplexer shown in FIG. 26.

FIG. 26 shows an eleventh embodiment of the present invention, which is a perspective view showing a antenna duplexer using as a filter for reception (Rx) a band-pass filter having a pole in the rejection range 44 according to the first embodiment and using as a filter for transmission (Tx) a band-rejection filter 45 according to the third embodiment. In the eleventh embodiment, the whole of a matching circuit 52 is constituted by two inductances and one capacitance. Pattern inductors 4 and 6 are used as the inductances, and a chip capacitor 5 is used as the capacitance. FIG. 27 shows an equivalent circuit of the antenna duplexer. Inductance elements or capacitors 7 are formed between the filter for reception (Rx) 44 and the filter for transmission (Tx) 45 and a Tx input electrode **46*k* connected to a transmitter 53, an Rx output electrode 46*m* connected to a receiver 54, and an antenna electrode 46*n* connected to an antenna 55, as shown in FIG. 26**. However, there is no strict solution for finding the values of the respective elements. In the present embodiment, therefore, the following procedure is used so as to determine the values of the inductance elements or capacitors.

The characteristics of the filter for reception (Rx) and the filter for transmission (Tx) are found by simulation or measurement. The characteristics are represented by data of a frequency having a sufficiently small width and an S parameter corresponding to the frequency, and are inputted to an electronic computer. A suitable objective function is determined to perform an optimization calculation. Examples of a method of optimization include the Monte Carlo method. An example of the objective function is represented by the following equation (5):

$$G = \int_{f1}^{f2} (-100S_{46n\text{-}46k} + 10S_{46n\text{-}46n} + 10S_{46k\text{-}46k} + S_{46n\text{-}46k})\, df + \int_{f3}^{f4} (-100S_{46n\text{-}46k} + 10S_{46n\text{-}46n} + 10S_{46m\text{-}46m} + S_{46m\text{-}46k})\, df \quad (5)$$

where f1 to f2 indicate frequencies in a received wave band, f3 to f4 indicate frequencies in a transmitted wave band, and Snm is an S parameter represented in decibel notation of the antenna duplexer, and terminal numbers correspond to those shown in FIG. 27. 100 and 10 which are coefficients of the S parameter are weights.

As a result of the optimization, connection is switched to an opened state when the absolute value of the value of an element represented by an impedance is extremely large, while being switched to a short-circuited state when it is extremely small. The optimization is further performed to determine a final circuit. As a measure of the switching at this time, the connection is switched to an opened state when the absolute value is not less than 200Ω, while being switched to a short-circuited state when it is not more than 10Ω.

Figure 28:
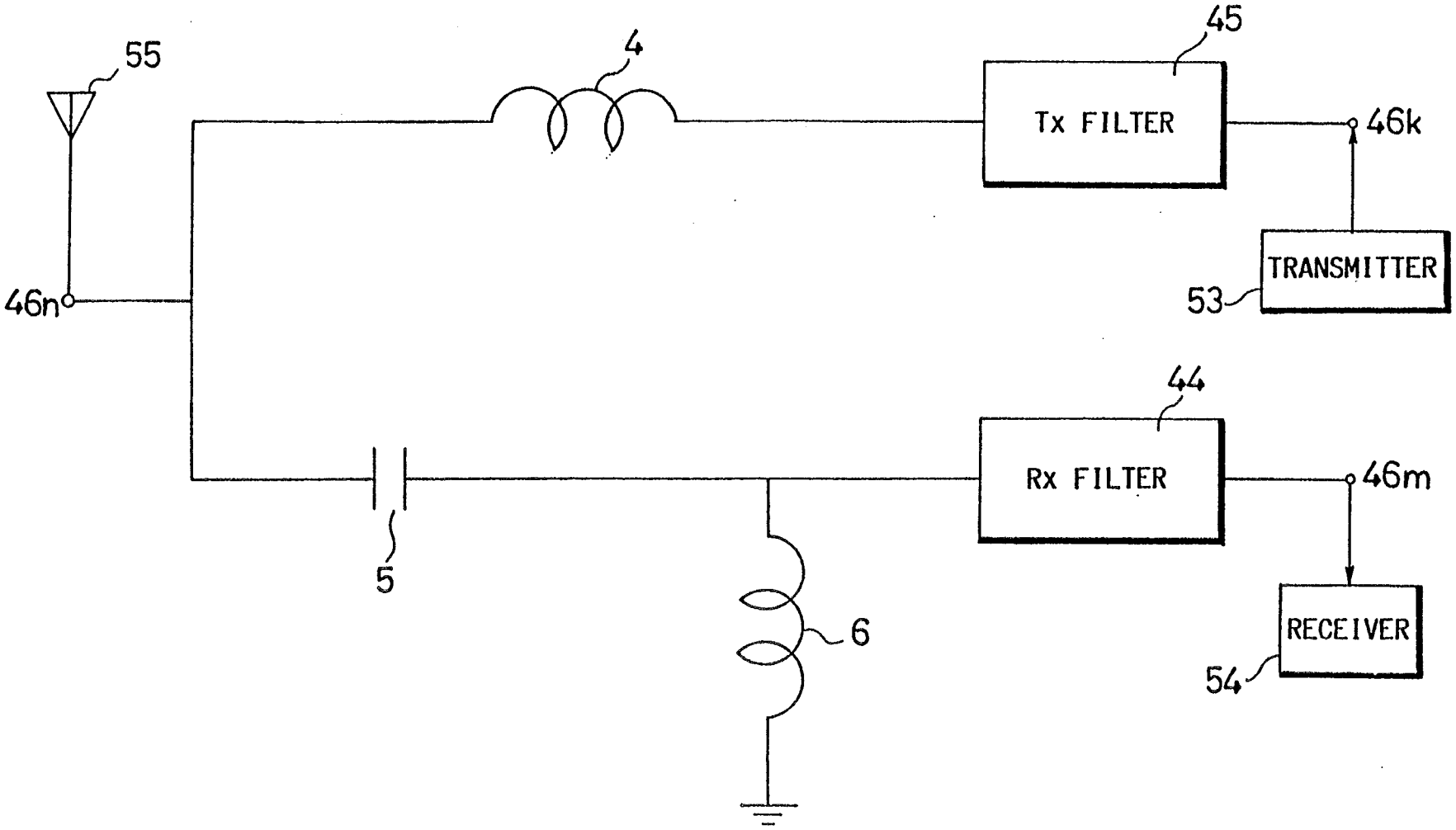
FIG. 28 is a schematic diagram showing an equivalent circuit of a antenna duplexer according to a twelfth embodiment of the present invention.

FIG. 28 is a diagram showing an equivalent circuit of a antenna duplexer according to a twelfth embodiment, showing one example in which optimization is performed in the eleventh embodiment. The connection from an antenna electrode **46*n* to a ground conductor and the connection from a filter for transmission 45 to the ground conductor are switched to an opened state. An inductor 4 of approximately 6 nH is positioned between the antenna electrode 46*n* and the filter for transmission 45, and a capacitor 5 of approximately 1.5 pF is positioned between the antenna electrode 46*n* and a filter for reception 44. Further, an inductor 6 of approximately 10 nH is positioned between the filter for reception 44** and the ground conductor.

Figure 29:
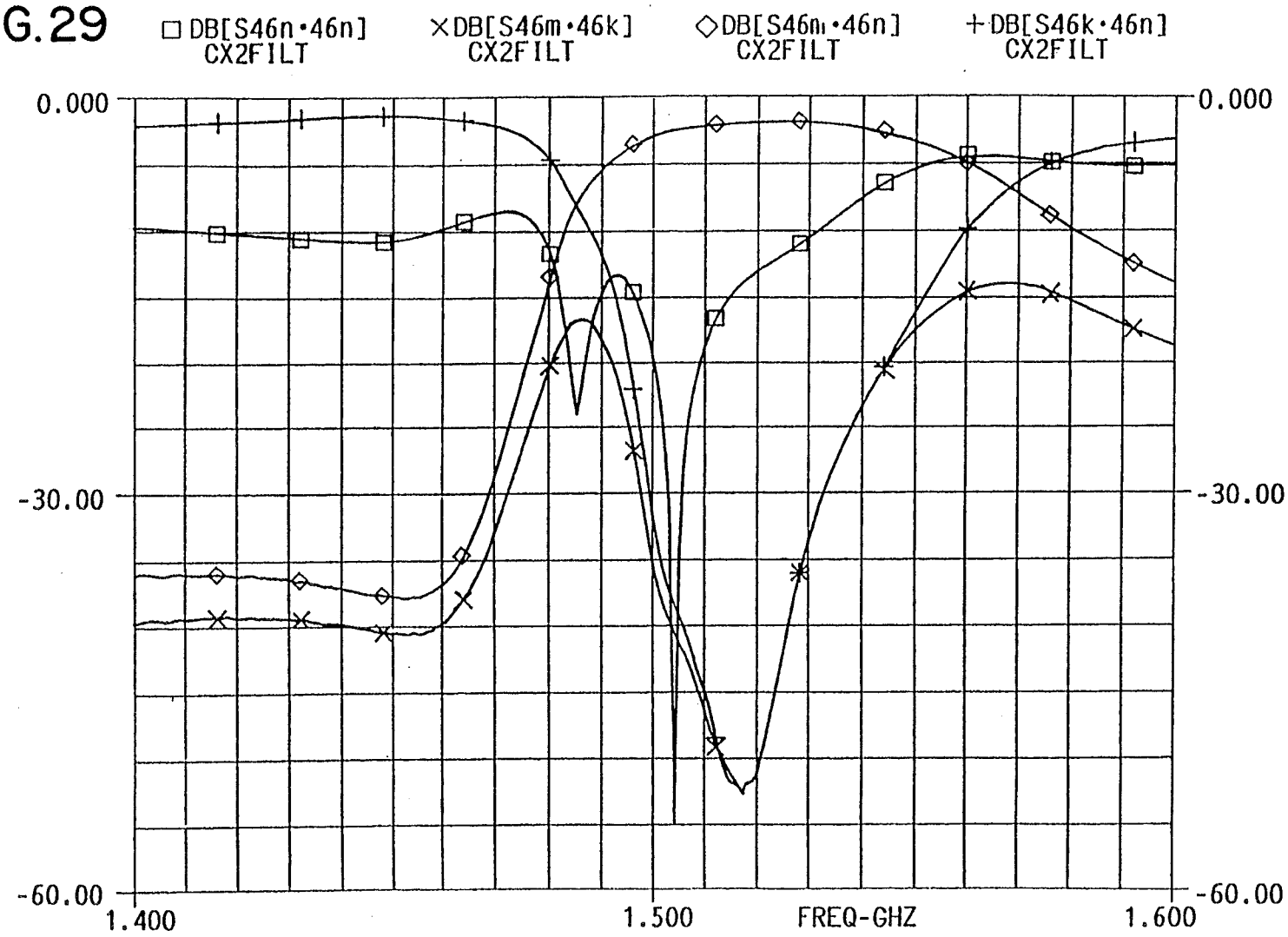
FIG. 29 is a diagram showing the frequency characteristics of the antenna duplexer according to the twelfth embodiment of the present invention.

FIG. 29 shows the characteristics of the antenna duplexer according to the twelfth embodiment. Terminal numbers of an S parameter correspond to those shown in FIG. 28. It is assumed that a transmitted wave band is 1.453 to 1.465 GHz, and a received wave band is 1.501 to 1.513 GHz. The insertion loss of a received wave is 2.7 dB and the return loss thereof is 9.2 dB, the insertion loss of a received wave is 1.7 dB and the return loss thereof is 16 dB, and the degree of separation between transmission and reception is 38 dB.

Figure 30:
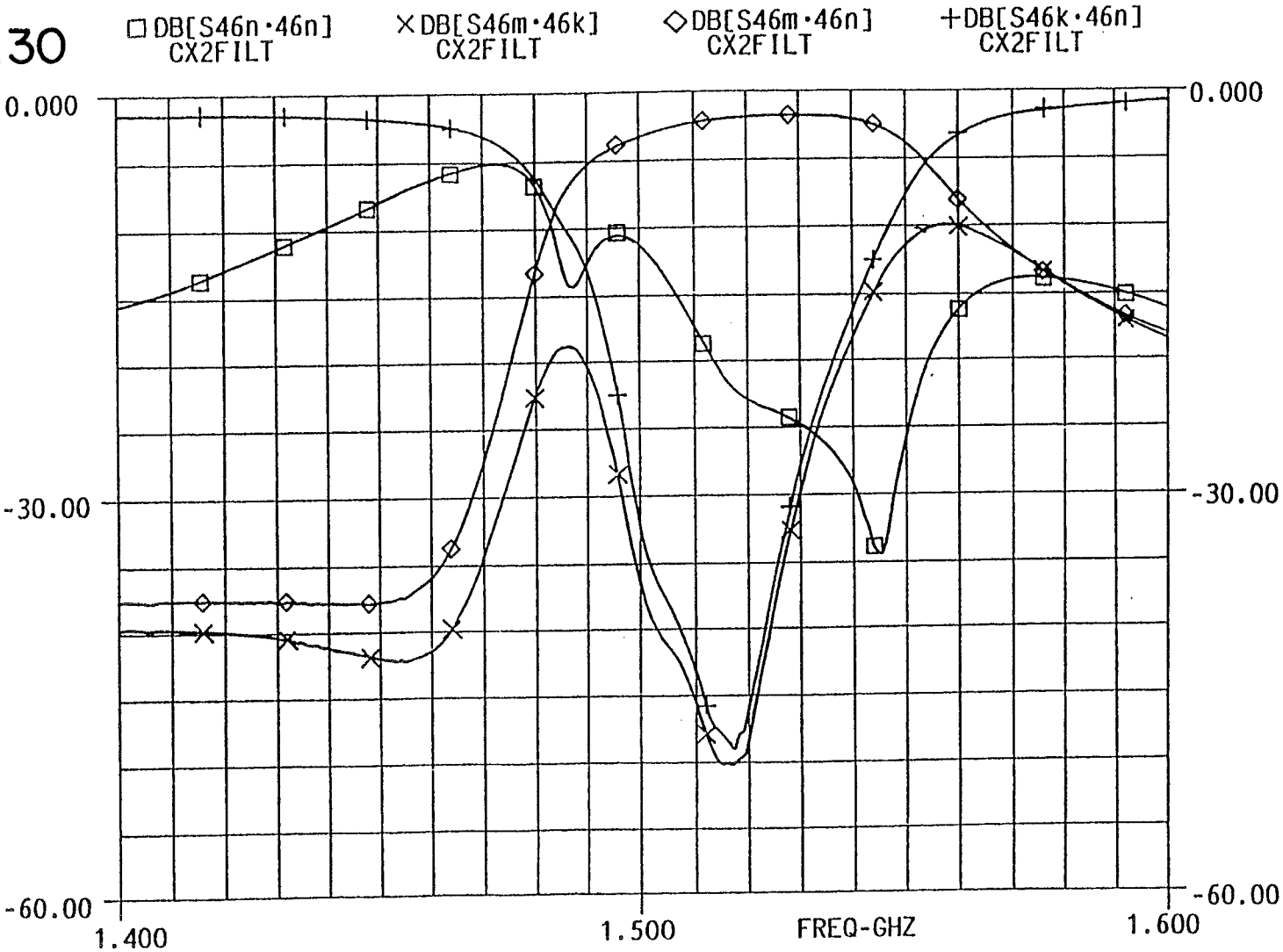
FIG. 30 is a diagram showing the frequency characteristics of the antenna duplexer according to the ninth embodiment of the present invention.

FIG. 30 shows the characteristics of the antenna duplexer according to the ninth embodiment. A transmitted wave band and a received wave band are the same as the above described ones. The insertion loss of a received wave is 2.9 dB and the return loss thereof is 11.4 dB, the insertion loss of a transmitted wave is 2.6 dB and the return loss thereof is 5.8 dB, and the degree of separation between transmission and reception is 38 dB. It can be confirmed from comparison between FIG. 29 and FIG. 30 that in the twelfth embodiment, the insertion loss is smaller and the return loss is larger, that is, the characteristics are higher.

According to the present invention, capacitance forming electrodes provided on a dielectric substrate form antiresonance capacitances between the electrodes and inner peripheral conductors, and a reactance element for coupling the capacitance forming electrodes is formed on the dielectric substrate, thereby to obtain a dielectric filter which is easily manufactured and is small in size. Furthermore, in a antenna duplexer using the dielectric filter as filters for transmission and reception, matching circuits can be simultaneously provided on the dielectric substrate comprising capacitance forming electrodes of both the filters, thereby to simplify the construction and make the manufacture easy.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A dielectric filter comprising:

a plurality of coaxial resonators, each of said coaxial resonators comprising:

a dielectric block having an outer peripheral surface and an inner peripheral surface parallel to a common axis and having first and second end faces crossing said axis, first and second conductive layers coating said outer peripheral surface and said inner peripheral surface, respectively, a third conductive layer formed on said second end face for short-circuiting said first and second conductive layers, a depressed part formed by removing a portion of the first conductive layer on the side of said first end face, and a dielectric substrate having a plurality of electrodes for external connection formed on its one major surface and having a plurality of ground electrodes corresponding to said electrodes for external connection and electrically insulated from one another to prevent input/output direct coupling to increase out-of-passband attenuation characteristics of said filter, said plurality of ground electrodes being formed on the other major surface and mounted on said depressed part with said one major surface being abutted thereon.

2. The dielectric filter according to claim 1, wherein the electrodes for external connection formed on said one major surface of said dielectric substrate are capacitance forming electrodes, said ground electrodes on said other major surfaces correspond to said capacitance forming electrodes, and said ground electrodes are electrically insulated from one another.

3. A dielectric filter comprising:

a dielectric block having an outer peripheral surface and a peripheral of inner peripheral surfaces parallel to a common axis and having first and second end faces crossing said axis;

a first conductive layer formed on said outer peripheral surface;

a plurality of second conductive layers formed on the plurality of inner peripheral surfaces;

a third conductive layer formed on said second end face for short-circuiting said first and second conductive layers;

a depressed part formed by removing a portion of the first conductive layer on the side of said first end face; and a dielectric substrate having a plurality of electrodes for external connection formed on its one major surface and having a plurality of ground electrodes corresponding to said electrodes for external connection and electrically insulated from one another to prevent input/output direct coupling to increase out-of-passband attenuation characteristics of said filter, said plurality of ground electrodes being formed on the other major surface and mounted on said depressed part with said one major surface being abutted thereon.

4. The dielectric filter according to claim 3, wherein the electrodes for external connection formed on said one major surface of said dielectric substrate are capacitance forming electrodes, said ground electrodes on said other major surface correspond to said capacitance forming electrodes, and said ground electrodes are electrically insulated from one another.

5. A dielectric filter comprising:

a plurality of coaxial resonators, each of said coaxial resonators comprising:

a dielectric block having an outer peripheral surface and an inner peripheral surface parallel to a common axis and having first and second end faces crossing said axis, first and second conductive layers coating said outer peripheral surface and said inner peripheral surface, respectively, a third conductive layer formed on said second end face for short-circuiting said first and second conductive layers, and a depressed part formed by removing a portion of the first conductive layer including a portion of the dielectric block on the side of said first end face; and a dielectric substrate having a plurality of electrodes for external connection formed on its one major surface and having a plurality of ground electrodes corresponding to said electrodes for external connection and electrically insulated from one another to prevent input/output direct coupling to increase out-of-passband attenuation characteristics of said filter, said plurality of ground electrodes being formed on the other major surface and mounted on said depressed part with said one major surface being abutted thereon.

6. A dielectric filter comprising:

a dielectric block having an outer peripheral surface and a plurality of inner peripheral surfaces parallel to a common axis and having first and second end faces crossing said axis;

a first conductive layer formed on said outer peripheral surface;

a plurality of second conductive layers formed on the plurality of inner peripheral surfaces;

a third conductive layer formed on said second end face for short-circuiting said first and second conductive layers;

a depressed part formed by removing a portion of the first conductive layer including a portion of the dielectric block on the side of said first end face; and a dielectric substrate having a plurality of electrodes for external connecting formed on its one major surface and having a plurality of ground electrodes corresponding to said electrodes for external connection and electrically insulated from one another to prevent input/output direct coupling to increase out-of-passband attenuation characteristics of said filter, said plurality of ground electrodes being formed on the other major surface and mounted on said depressed part with said one major surface being abutted thereon.

* * * * *